US006695056B2

(12) United States Patent
Haugen et al.

(10) Patent No.: US 6,695,056 B2
(45) Date of Patent: Feb. 24, 2004

(54) SYSTEM FOR FORMING A WINDOW AND DRILLING A SIDETRACK WELLBORE

(75) Inventors: David M. Haugen, League City, TX (US); John D. Roberts, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/079,139

(22) Filed: Feb. 20, 2002

(65) Prior Publication Data

US 2002/0170713 A1 Nov. 21, 2002

Related U.S. Application Data

(63) Continuation-in-part of application No. 09/658,858, filed on Sep. 11, 2000, now Pat. No. 6,536,525.

(51) Int. Cl.[7] ..... E21B 23/00; E21B 23/12

(52) U.S. Cl. ..... 166/297; 166/298; 166/382; 166/117.6; 166/55.2

(58) Field of Search ..... 166/117.6, 123, 166/297, 298, 55.2, 382; 175/4.55, 4.6

(56) References Cited

U.S. PATENT DOCUMENTS

| | | | | |
|---|---|---|---|---|
| 4,598,769 A | | 7/1986 | Robertson | 166/55 |
| 5,636,692 A | | 6/1997 | Haugen | 166/298 |
| 5,709,265 A | | 1/1998 | Haugen et al. | 166/55.2 |
| 5,791,417 A | | 8/1998 | Haugen et al. | 166/298 |
| 5,826,651 A | * | 10/1998 | Lee et al. | 166/117.6 |
| 5,887,668 A | * | 3/1999 | Haugen et al. | 175/79 |
| 5,894,889 A | * | 4/1999 | Dewey et al. | 166/298 |
| 6,024,169 A | | 2/2000 | Haugen | 166/298 |
| 6,135,215 A | * | 10/2000 | Ericksen | 175/61 |
| 6,167,961 B1 | * | 1/2001 | Pollard et al. | 166/117.6 |
| 6,202,752 B1 | | 3/2001 | Kuck et al. | 166/298 |
| 6,360,821 B1 | * | 3/2002 | Braddick | 166/117.6 |

FOREIGN PATENT DOCUMENTS

| | | |
|---|---|---|
| EP | 0 819 827 A2 | 1/1998 |
| GB | 2 346 633 A | 8/2000 |

* cited by examiner

*Primary Examiner*—Frank Tsay
(74) *Attorney, Agent, or Firm*—Moser, Patterson & Sheridan, L.L.P.

(57) ABSTRACT

The present invention discloses and claims a system for forming an opening, or window, in a downhole tubular for the subsequent formation of a lateral wellbore. In the system of the present invention, an apparatus is run into the parent wellbore which includes at least a tubular having a drill bit, a diverter such as a whipstock releasably connected to the drill bit, an anchoring device such as a packer, and a milling device. This apparatus allows for the milling of a window in the parent wellbore, and the drilling of a lateral wellbore through that window, in a single trip.

30 Claims, 17 Drawing Sheets

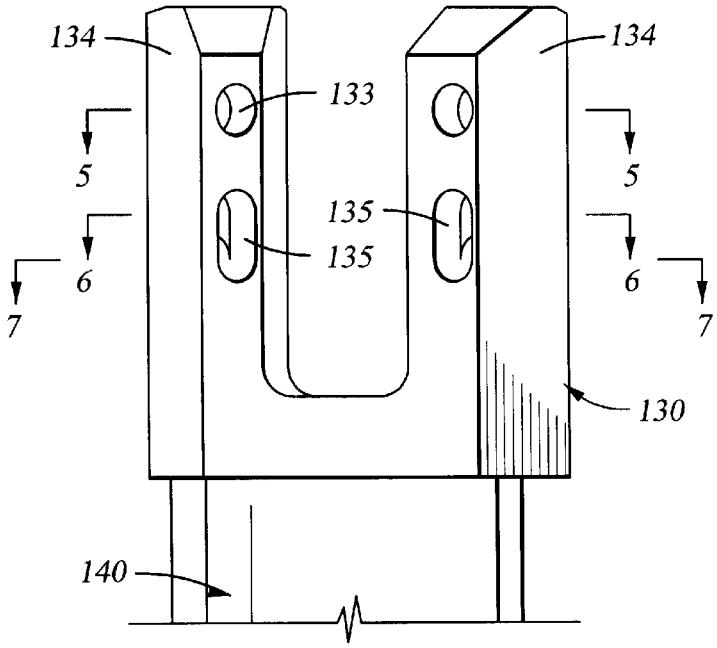
Fig. 3
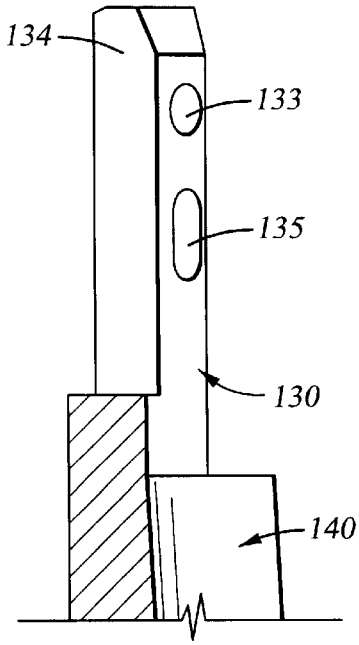
Fig. 4
Fig. 5
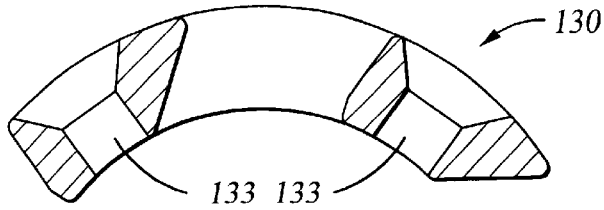
Fig. 6
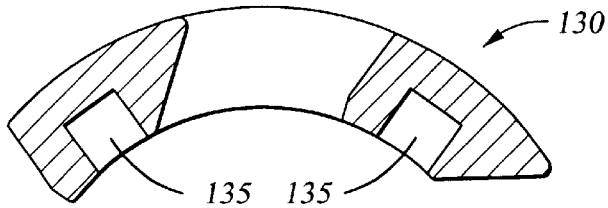
Fig. 7
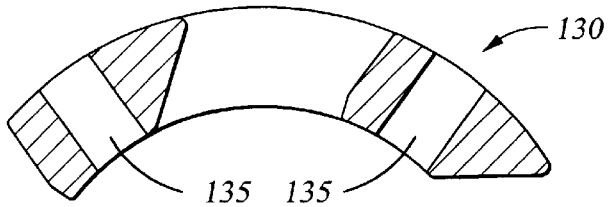

SYSTEM FOR FORMING A WINDOW AND DRILLING A SIDETRACK WELLBORE

CROSS-REFERENCE TO RELATED APPLICATIONS

This application is a continuation-in-part of co-pending U.S. patent application Ser. No. 09/658,858, filed Sep. 11, 2000, now U.S. Pat. No. 6,536,525 which is incorporated by referenced herein in its entirety.

BACKGROUND OF THE INVENTION

1. Field of the Invention

This invention is related to the practice of sidetrack drilling for hydrocarbons. More specifically, this invention pertains to a system for creating a window within a vertical wellbore casing and then drilling a sidetrack wellbore through that window in a single trip.

2. Background of the Related Art

In recent years, technology has been developed which allows an operator to drill a primary vertical well, and then continue drilling an angled lateral borehole off of that vertical well at a chosen depth. Generally, the vertical wellbore is first cased with a string of casing and cemented. Then a tool known as a whipstock is positioned in the casing at the depth where deflection is desired. The whipstock is specially configured to divert milling bits and then a drill bit in a desired direction for forming a lateral borehole. This process is sometimes referred to as sidetrack, or directional, drilling.

To create a lateral wellbore, an anchor, slip mechanism, or an anchor-packer is first set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore.

A whipstock is next run into the wellbore. A stinger is located at the bottom of the whipstock which engages the anchor device or packer. In this respect, splined connections between the stinger and the anchor facilitate correct stinger orientation. The stinger allows the concave face of the whipstock to be properly oriented so as to direct the milling operation.

For sidetracking operations, it is most commonly known to employ a mill having cutting blades, with the mill being placed at the end of the drill pipe or other tubular column. A starting mill is releasably secured at the top of the whipstock, e.g. with a shearable setting stud connected to a pilot lug on the whipstock. Rotation of the string with the starting mill rotates the mill, causing the connection with the whipstock to be sheared.

The starting mill has a tapered portion which is slowly lowered to contact the pilot lug on the concave face of the whipstock. The starting mill moves downwardly while contacting the pilot lug or the concave portion. This urges the starting mill into contact with the casing. The casing is milled as the pilot lug is milled off. Milling of the casing is achieved by rotating the tool against the inner wall of the casing while at the same time exerting a downward force on the drill string against the whipstock. The starting mill cuts an initial window in the casing. The starting mill is then removed from the wellbore.

A window mill, e.g. on a flexible joint of drill pipe, is next lowered into the wellbore. The window mill is rotated to mill down from the initial window formed by the starting mill. A window is thereby created in the form of an elongated opening pocket. The window mill is then removed from the wellbore.

As a next step, the drill string is tripped. A drill bit is then run on drill string which is deflected by the whipstock through the freshly milled window. The drill bit engages the formation so as to directionally form the lateral borehole adjacent the window.

As can be seen, sidetracking operations which employ a whipstock and mill require the use of various tools in a certain sequence. This sequence of operation requires a plurality of "trips" into the wellbore. For example, the first trip occurs after drilling has reached a depth below the desired depth for the window. The drill string is pulled so that the drill bit may be replaced with a packer. The packer is then run to a desired depth and set.

After setting the packer, the drill string is tripped to run the whipstock. The whipstock is set down hole above the packer. Technology has been recently developed which allows the milling device to be run with the whipstock. U.S. Pat. No. 6,112,812 discloses a mill which is releasably secured at the top of the whipstock, e.g. with a shearable setting stud connected to a pilot lug on the whipstock. The mill and whipstock can then be lowered into the wellbore together. Rotation of the string rotates the mill, and causes shearing of the connection with the whipstock. However, as also noted, it is necessary to start the milling process with a smaller gauge mill, and then move to progressively larger gauge mills to complete the window. In some instances, full gauge mills are not run to mill a full gauged window through the casing on a singular trip, but rather are run on subsequent trips after a starting mill is run. This requires still further trips.

Once the window is milled, the final milling device must be removed from the wellbore. At the surface, the mill is replaced with the drill bit, and drilling through the new window downhole commences.

The process of running drill string in and out of the hole is time consuming. As can be seen, multiple trips are typically required in order to complete a sidetrack drilling operation. Rig time is expensive and multiple trips take time and add to the risk that problems will occur. In an effort to reduce the number of trips, a milling device incorporating more than one mill gauge has recently been developed. Similarly, U.S. Pat. No. 6,116,336 discloses a packer and a whipstock being run together. More impressively, U.S. Pat. No. 6,112,812 discloses a milling device having both a whipstock and an anchor attached such that these three devices can b e run and operated in a single trip. However, no method has been disclosed which would combine, into a single trip, the placement of an anchor, a whipstock, a milling device, and a drill bit for finally drilling the lateral wellbore. Thus, a need exists for such a system.

In addition, the standard method for creating a casing window for a lateral hole requires the use of drilling fluids which are pumped into the formation to circulate casing cuttings, or cutting swarf, and to cool the cutting blades. This further adds to the expense of the sidetracking process. U.S. Pat. No. 5,791,417 discloses a system for opening a window in casing for sidetrack drilling operations by the use of an explosive charge. This system allows the charge to be applied to a portion of casing in the same trip as running the whipstock. However, a need still exists which would allow subsequent drilling of a lateral wellbore through the window in that same trip. Thus, a need exists for an effective "single trip" method for forming a window in wellbore casing whereby a window is formed and the lateral wellbore is drilled in a single trip.

Therefore, one of the many objects of this invention is to eliminate the need for multiple trips in connection with sidetrack drilling.

Further, it is an object of the present invention to provide a system for forming a casing window for sidetrack drilling operations whereby an anchor, a whipstock, a milling device and a drill bit for drilling the lateral wellbore itself are run in the same trip.

Still further, it is an object of one embodiment of the present invention to provide a single trip system for forming a casing window for sidetrack drilling operations without rotation of the drill string.

SUMMARY OF THE INVENTION

The present invention discloses and claims a system for forming an opening, or a window, in a downhole tubular for the subsequent formation of a lateral wellbore. More specifically, a system for creating a window in a wellbore, and then drilling a sidetrack wellbore through that window, is provided. According to the system of the present invention, a series of tools is run on a drill string into the primary wellbore. These tools allow for the milling of a window in the casing of a wellbore, and then for the drilling of a lateral wellbore through that window, in the same trip.

To effectuate the system of the present invention, a drill bit is run into the primary wellbore on the lower end of a drill string. A diverter, known in the industry as a whipstock, is attached temporarily to the drill bit with a mechanically shearable connection. The whipstock is run into the wellbore along with and below the drill bit. The whipstock includes a concave face for properly diverting the drill bit into the lateral wellbore. It may also include a pilot lug for temporarily connecting the drill bit with the whipstock.

At the base of the whipstock is an anchor. The anchor is used to set the whipstock in place for sidetrack drilling operations.

A milling device is next provided. The milling device creates a window in the casing through which sidetrack drilling operations enter. In the preferred embodiment, the milling device is lowered on the drill string below the anchor. The milling device is appropriately located downhole and oriented. The milling device is then activated to create a hole through which drilling of the formation adjacent the primary wellbore is possible.

Various milling devices may be employed in connection with the system of the present invention. In one embodiment, the milling device utilizes pyrotechnic means for cutting a window through the casing. Such pyrotechnic means may include a container having an exothermic material. The exothermic material is lowered into the wellbore at a predetermined depth. Thereafter, the exothermic material is ignited and a portion of the casing therearound is destroyed, leaving a window in the casing.

In another embodiment, the milling device is a reciprocating mill in the form of a broach. The broach includes teeth for mechanically cutting an opening through the casing.

In still another embodiment, the milling device is an explosive charge. The charge is used to explosively form an opening in the casing. The explosive charge is properly designed to form a hole of desired configuration in the casing without damaging the anchor or whipstock.

In operation downhole, the milling device is employed in the system of the present invention before the anchor is set. The device's orientation is checked by running a tool such as a gyroscope indicator or measuring-while-drilling device into the wellbore. The milling process is then conducted. When milling is completed, the whipstock is lowered into the wellbore and located adjacent the newly formed window. Once the whipstock is in place and properly oriented, the anchor is set. Setting the anchoring device allows the drill bit to act against the whipstock and to be diverted through the window and into the formation in order to drill a lateral wellbore.

In the preferred embodiment, the drill bit is a fixed drill bit. The drill bit is temporarily attached to the whipstock by a pilot lug. The pilot lug is releasably connected to the drill bit at its upper end by shearable setting studs, and connected at its lower end to the whipstock. Pulling on the set drill string shears the setting studs, freeing the drill bit from the whipstock. Slips extend from the stinger and engage the side of the wellbore to prevent movement of the whipstock in the wellbore; and locking apparatus locks the stinger in a packer when a packer is used. Rotation of the drill string rotates the drill bit. The drill bit is slowly lowered to contact the pilot lug on the concave face of the whipstock. This forces the drill bit through the formed window, and a new lateral wellbore is drilled as the pilot lug is milled off.

In yet another embodiment, an apparatus in run into a wellbore, the apparatus including a run in string of tubulars, a drill bit, a diverting device and a milling device. Thereafter, an aperture is formed in a casing wall with the milling device and the milling device is then disconnected from the drill bit and string. Thereafter, the bit is directed through the newly formed aperture in the casing and a lateral wellbore is formed. The diverting device can include a whipstock, a rotary steering means or a bent sub disclosed proximate the drill bit.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a view of the inside surface of the fingers for a pilot lug of the present system, illustrating the circular and elongated apertures formed therein.

FIG. 4 is a side view, partially in section of the pilot lug of FIG. 3.

FIGS. 5–7 are section views taken along lines 5—5, 6—6 and 7—7 of FIG. 3 and depicting the circular and elongated apertures in the pilot lug.

DETAILED DESCRIPTION OF THE PREFERRED EMBODIMENT

Figure 1:
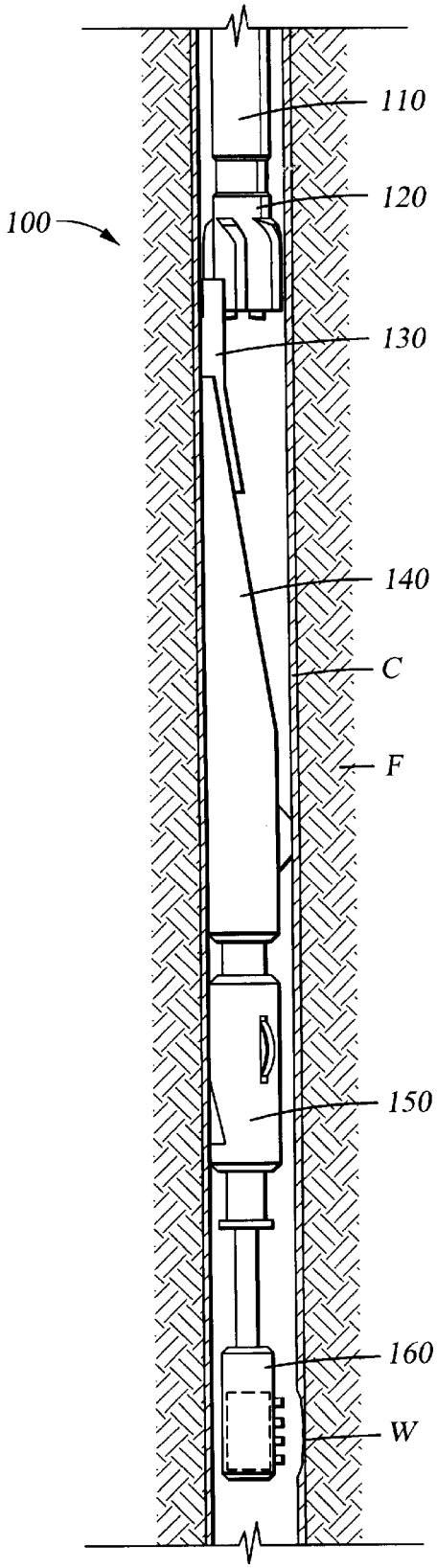
FIG. 1 is a schematic view of the system of the present invention including a drill string, a drill bit, a whipstock, an anchoring device, and a milling device. In the embodiment shown, the milling device is an explosive milling device.

FIG. 1 illustrates one embodiment of the system 100 of the present invention for milling a window in a wellbore, and for drilling a sidetrack wellbore therefrom. The system 100 first includes a drill string 110, with a drill bit 120 disposed at a lower end of the drill string 110. The drill bit 120 is attached to a diverter, or whipstock 140, by means of a pilot lug 130. The pilot lug 130 typically includes setting studs (shown in FIG. 2) designed to fail upon a predetermined compressive or tensile force applied between the drill bit 120 and the whipstock 140. Fixed below the whipstock 140 is a milling device 160. The milling device 160 is used to fashion a window in the casing C. The milling device 160 is attached to the system 100 by an anchor 150. The anchor 150 is connected to the base of the whipstock 140 and suspends the milling device 160. The anchor 150 is set to hold the whipstock 140 in place after a window is milled and after the whipstock 140 is positioned relative to the window.

Referring first to the drill string 110, the drill string 110 is typically a tubular used to rotate a drill bit 120. In this instance, the drill string 110 is also used as a run-in string for the system 100. As used herein, a drill string is the length of tubular pipes, composed of the drill pipe and drill collars. The drill pipe 110 is usually run into a wellbore in sections or joints. While the embodiment shown in FIG. 1 utilizes drill pipe 110 as the working string, it is within the scope of this invention to employ coiled tubing, casing (such as in a drilling-with-casing procedure) or other tubular as the working string. Further, it is within the scope of this invention to provide rotation of the drill bit 120 by a motor disposed within the wellbore 100 on coiled tubing.

The drill bit 120 is affixed to the lower end of the working tubular 110. In the preferred embodiment, the drill bit 120 is a fixed drill bit bit, meaning it does not employ rotary roller cones or other moving parts for milling the formation F. An example would be a polycrystalline diamond compact drill bit. However, the scope of the present invention is intended to include any type of drill bit.

Figure 2:
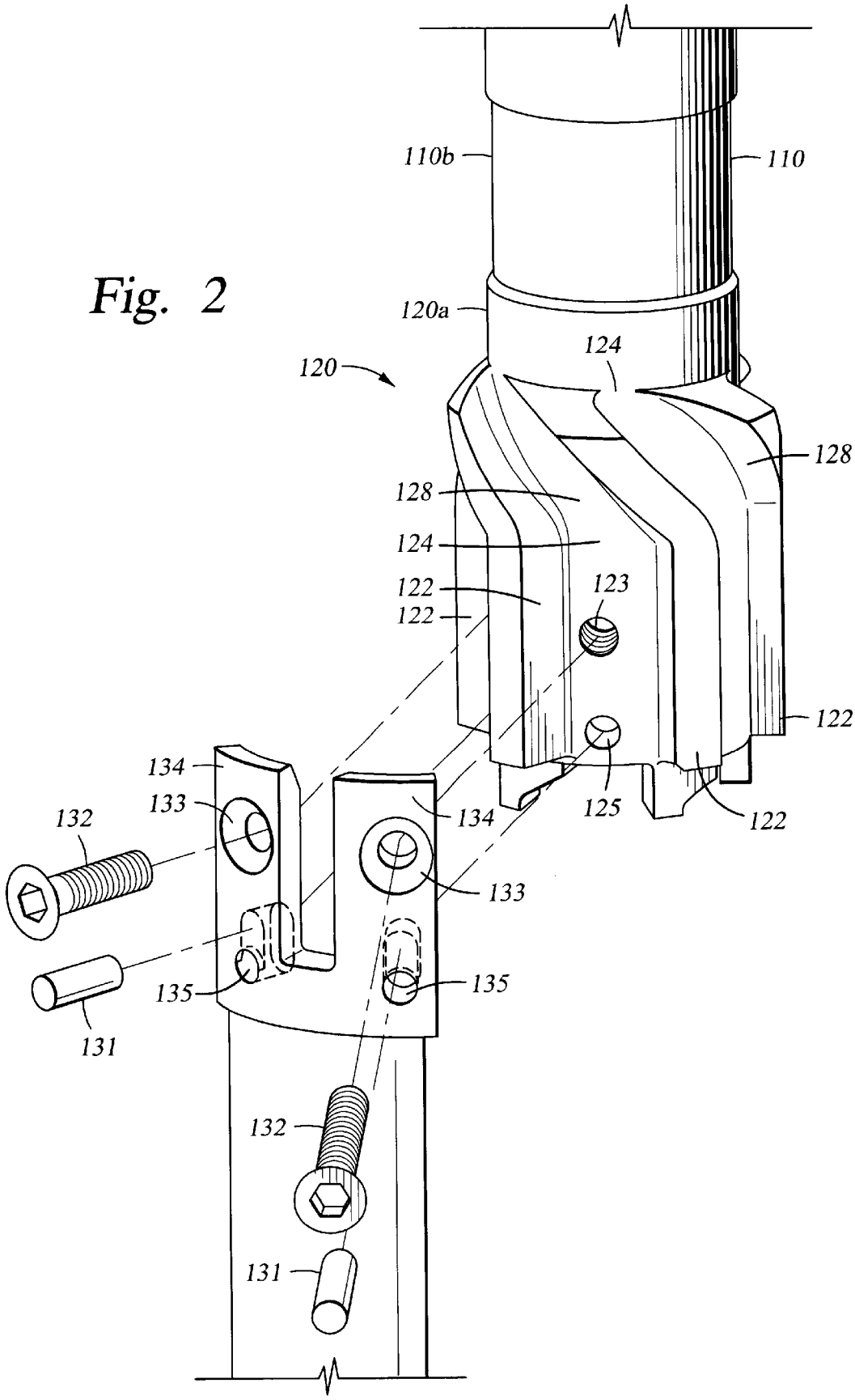
FIG. 2 is a perspective view of a drill bit of the present system, along with the upper portion of a pilot lug of the present invention and the shearable setting studs, in an exploded view.

FIG. 2 shows an example of a drill bit 120. The drill bit 120 has an upper end 120*a* configured to be threadedly connected to the lower end 110*b* of the drill pipe 110. In this manner, the drill bit 120 can be placed in fluid communication with the drill pipe 110. The drill bit 120 also comprises a body 124. The body 124 of the drill bit 120 supports a series of blades 122 for milling formation material F (shown in FIG. 1). In the preferred embodiment for the drill bit 120, the blades 122 are presented in a spiraling configuration.

Between the cutting blades 122 are recessed portions 128 for receiving fingers 134 of the pilot lug 130. Within these recessed portions 128 of the drill bit 120 is one or more bores 123. As will be shown below, the bores 123 receive setting studs 131 and 132 of the pilot lug 130 for temporarily connecting the drill bit 120 to the pilot lug 130. In this regard, the preferred embodiment for the system of the present invention utilizes a pilot lug 130 to temporarily connect the drillbit 120 to the whipstock 140. However, an equally viable embodiment would not include a separate pilot lug, but could provide for a shearable connection directly between the drillbit 120 and the whipstock 140.

FIG. 3 is a view of the inside surface of the fingers 134, and FIG. 4 is a side view thereof. The receiving fingers 134 of the lug 130 include apertures 133 and 135 therethrough which are designed to align with bores 123 and 125 in the recessed portion 128 of the drill bit 120.

Each finger 134 includes a first circular aperture 133 extending therethrough and another elongated aperture 135 therebelow terminating at the inside surface of the lug 130 in an elongated shape. FIG. 5, taken along lines 5—5 of FIG. 3, depicts the circular apertures 133 extending through the lug 130. As shown in the Figure, the apertures 133 are countersunk at an outside edge to house the head of a threaded member 132. FIG. 6 depicts the upper portion of elongated apertures 135 taken along lines 6—6 of FIG. 3. FIG. 7, taken along lines 7—7 of FIG. 3, depicts the lower portion of the elongated aperture 135 extending through the lug 130 and terminating in an elongated shape at the inside surface thereof.

Figure 8:
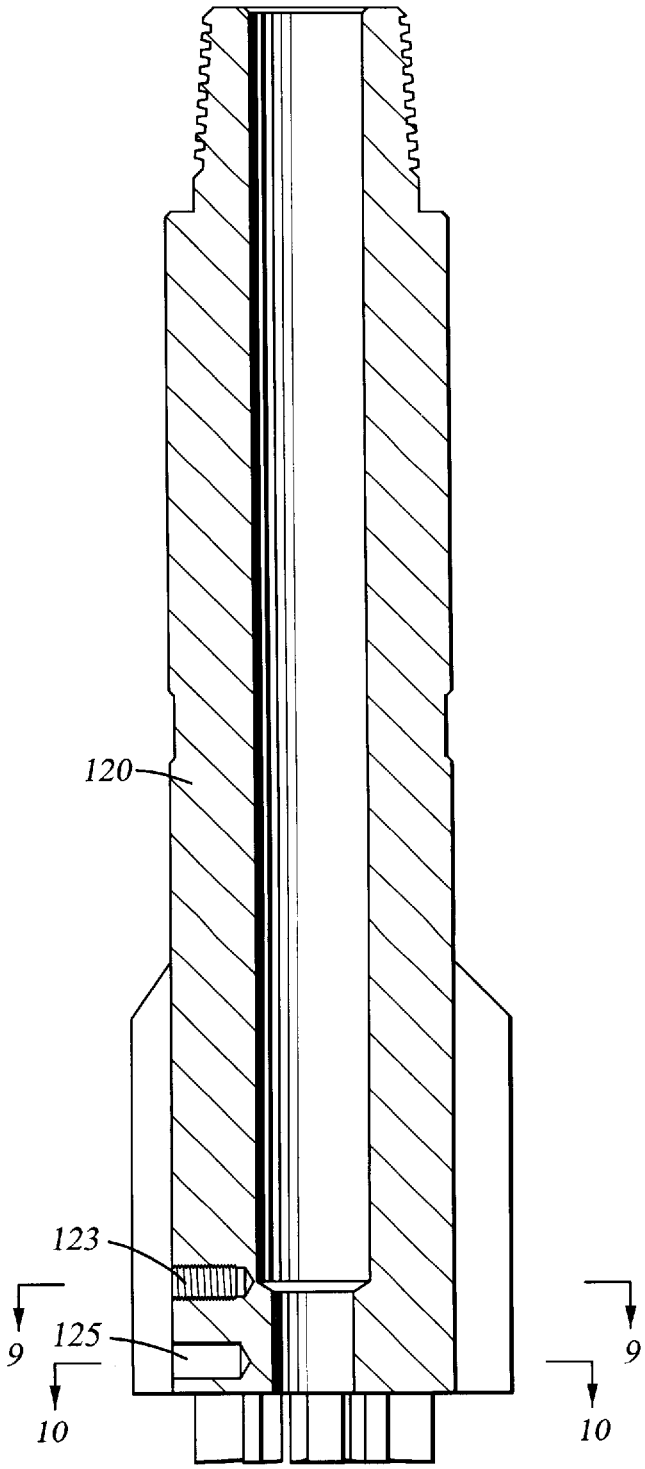
FIG. 8 is a cross-sectional view of a drill bit of the present invention.
Figure 9:
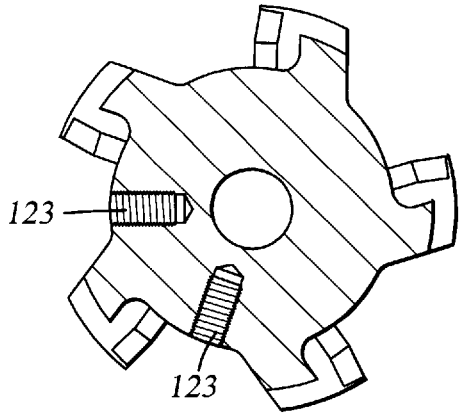
FIGS. 9 and 10 are section views taken along lines 9—9 and 10—10 of FIG. 8, and depicting the bores for receiving the shearable threaded connectors and pin members which temporarily connect the drill bit to the pilot lug.
Figure 10:
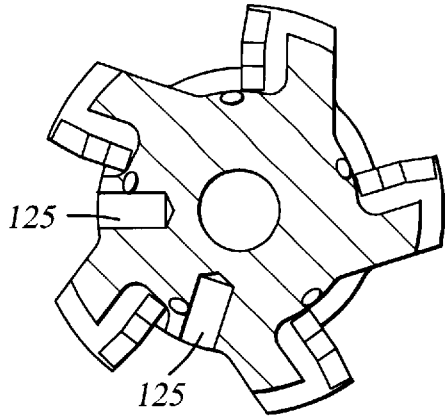

FIGS. 8–10 illustrate the bores 123 and 125 formed in the drill bit 120 that cooperate with the apertures 133 and 135 formed in the lug 130 to make up the shearable connection. Specifically, FIG. 8 shows the upper 123 and lower 125 receiving bores formed in the drill bit 120. In the preferred embodiment, the upper receiving bore 123 is threaded to receive a threaded setting stud 132 and the lower receiving bore 125 is non-threaded for receipt of pin-type setting stud 131 therein. In the preferred embodiment, a pair of threaded connectors 132 and a pair of pin members 131 are utilized. In this embodiment shown in FIG. 11, the pin members 131 are held in place by frictional forces between the pins 131 and bores 125. However, the pins 131 could be retained in the bore 125 by a latching mechanism (not shown) wherein the pins 131 lock into place through rotation, or similar embodiment.

Figure 12:
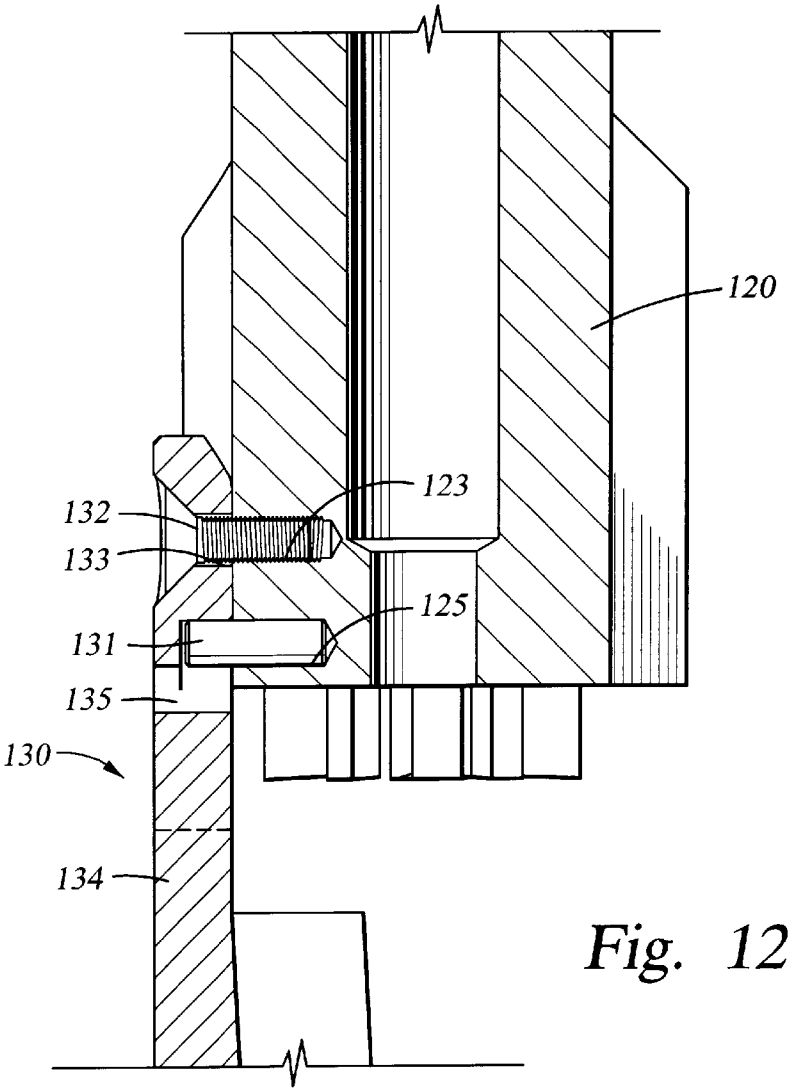
FIG. 12 is a section view showing the shearable connection of FIG. 11 prior to shearing, with both a threaded connector and pin member in place.
Figure 11:
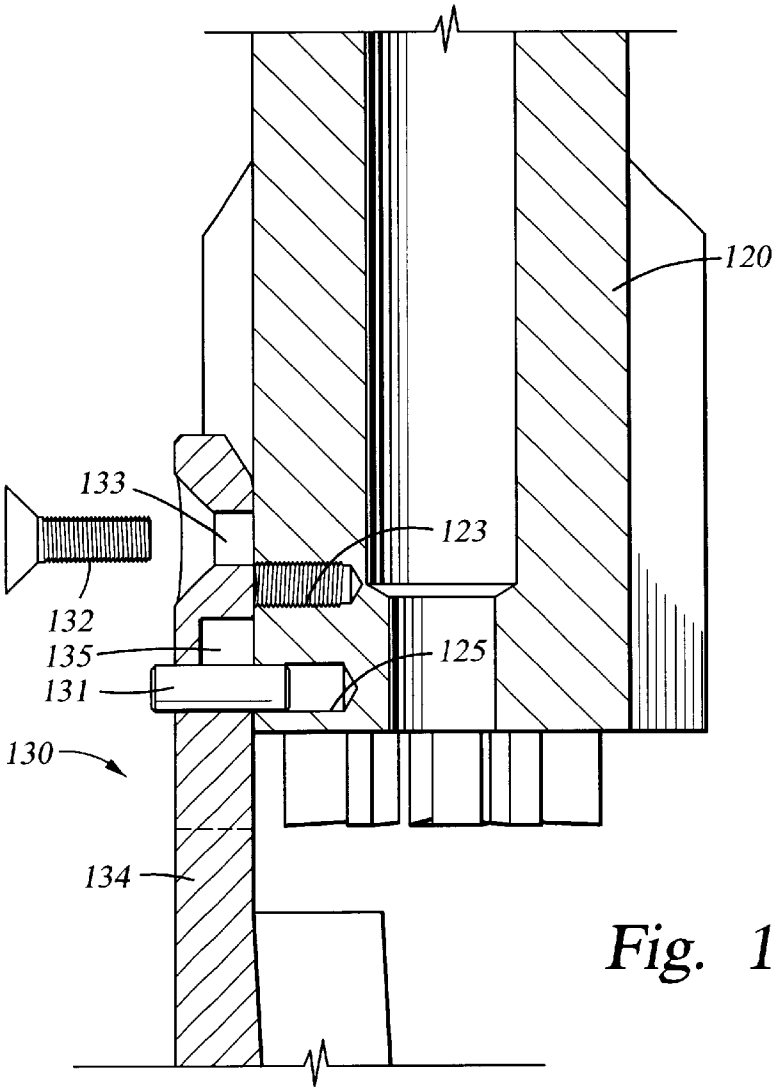
FIG. 11 is a section view showing the shearable connection between the pilot lug and the drill bit of FIG. 2, with a shearable pin member in place.

FIGS. 11–12 are section views depicting a preferred embodiment of the shearable connection between the drill bit 120 and the lug 130. Specifically, FIGS. 11 and 12 depict the manner in which the connection is assembled with a threaded member 132 placed in receiving bore 123, and a pin member 131 placed in receiving bore 125 of the drill bit 120. In the embodiment shown in FIG. 11, the pin member 131 is inserted into bore 125 first. Thereafter, pilot lug 130 is lowered to align aperture 133 with bore 123.

Then, as shown in FIG. 12, threaded connectors 132 are inserted through the circular aperture 133 in the finger 134 and into the upper receiving aperture 123 in the drill bit 120. This, again, is done after the pins 131 have been inserted into bores 123 and are free to travel within the elongated apertures 135 formed in the finger 134. FIG. 12 illustrates the shearable connection between the lug 130 and the drill bit 120 as it would appear in the well prior to shearing of the connection. Both the threaded connectors 132 and the pin members 131 are bearing the shear load. In this manner, the strength of the connection is enhanced when the assembly 100 is being lowered into the wellbore and a tensile force is being applied between the whipstock 140 and drill bit due 120 to the weight of the whipstock 140.

Figure 13:
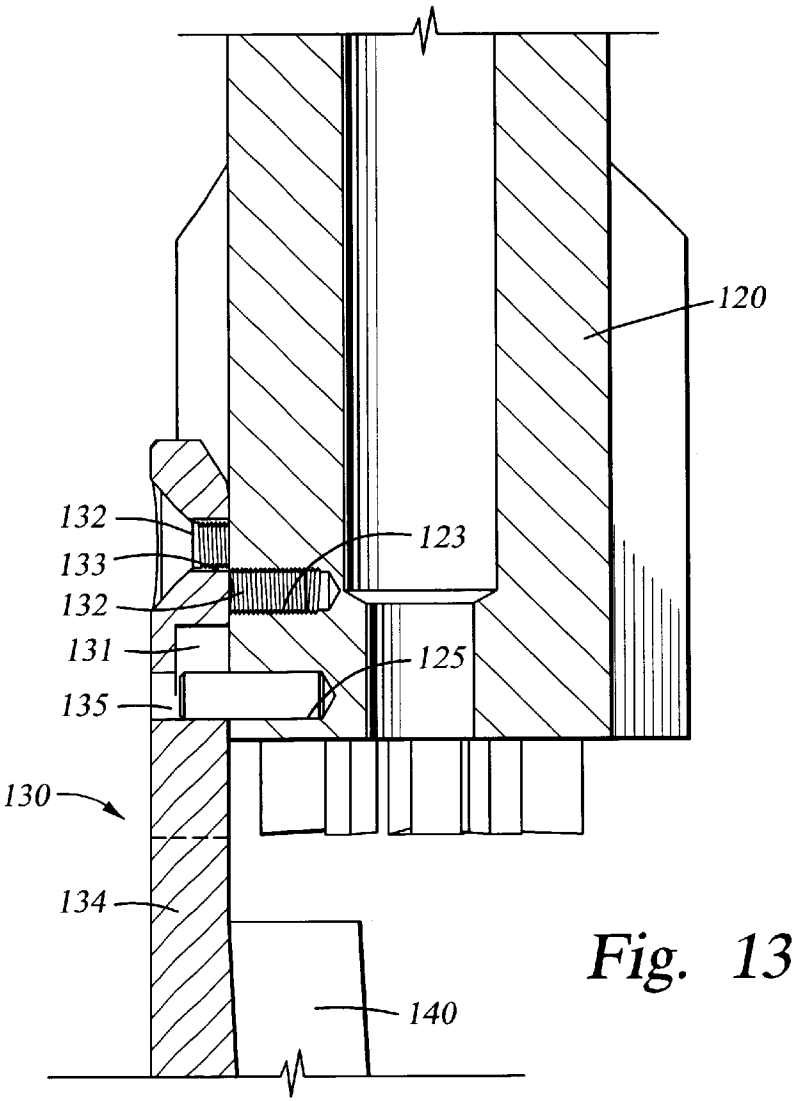
FIG. 13 is a section view showing the shearable connection of FIG. 11 as the threaded connector fails.

FIG. 13 depicts the shearable connection just after a tensile force has been applied to the drill bit 120 from above and sheared the threaded connectors 132. Specifically, the threaded connectors 132 have sheared and the drill bit 120 has moved down in relation to the lug 130 of the whipstock 140. Because the pin 131 is free to travel in the vertical space created by the slot shape, the pin 131 adds no initial resistive force to the tensile force applied between the whipstock 140 and drill bit 120.

Figure 14:
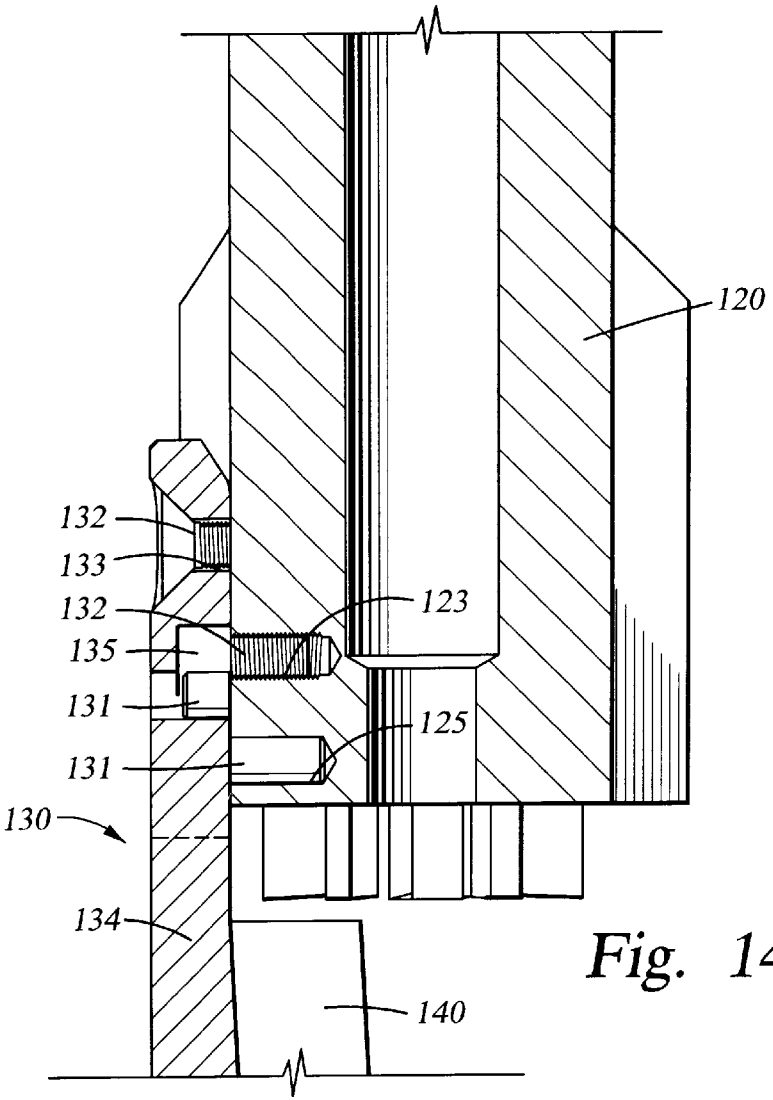
FIG. 14 is a section view showing the shearable connection of FIG. 11 as the pin member fails.

FIG. 14 depicts the shearable connection after the pin 131 has moved vertically in the slot-shaped aperture 135 and is then sheared by the force of the drill bit 120 moving downward in relation to the lug 130. In this manner, the compressive force necessarily applied between the whipstock 140 and drill bit 120 is limited to that force needed to shear only the threaded connectors 132. Thereafter, the force needed to shear the pin members 131 is largely supplied by the kinetic energy of the moving drill bit 120. In this manner, the shearable connection strength is not enhanced against a compressive force applied between the whipstock 140 and drill bit 120, but only against a tensile force applied therebetween.

Alternative embodiments for a shearable connection between the drill bit 120 and the lug 130 exist, such as those described in U.S. patent application Ser. No. 09/545,917 entitled "Whipstock Assembly," such disclosure being referred to and incorporated as if set forth at length herein. More specifically, alternative embodiments which fall within the scope of this application for a system 100 include those shown in FIGS. 15,16, 20 and 21 of Ser. No. 09/545, 917.

Figure 15A:
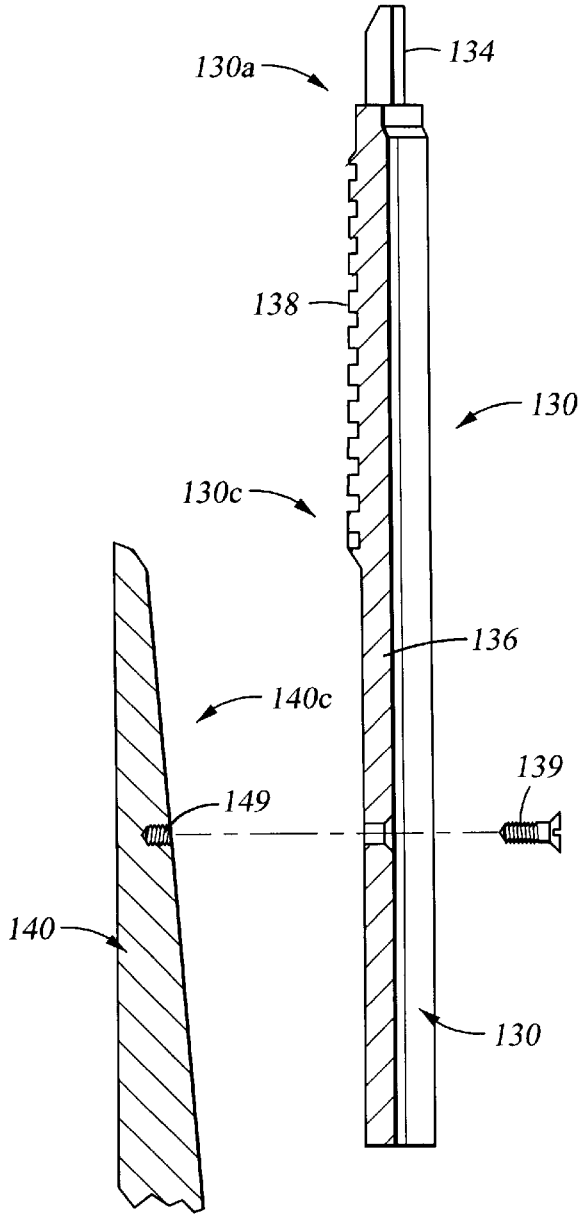
FIG. 15A is a sectional view of a pilot lug of the system of FIG. 1, taken from FIG. 15B along lines 15A—15A.

FIG. 15A depicts a cross-sectional view of a pilot lug 130 of the present invention along its entire length. At its upper end 130*a*, the pilot lug 130 has fingers 134 which extend upwardly from a body 136. As described above, the fingers 134 are releasably connected to the drill bit 120 (e.g. by shear bolts 132). Knobs 138 project from the convex side 130*c* of body 136. From top to bottom the knobs 138 project increasingly from the body 136 to correspond to a taper of the whipstock 140. Alternatively a series of up-and-down grooves (not shown) may be used instead of the knobs 138, to be mated in corresponding grooves (not shown) on the whipstock. It is within the scope of this invention, though not required, to employ at least one recess, a series of recesses, or a series of recesses at angles to each other to reduce the amount of material of the element 130.

The pilot lug 130 is temporarily connected to the whipstock 140. In the preferred embodiment, the pilot lug 130 is bolted to the whipstock 140 by shearable setting stud 139. However, the connection may be by welding, in which case shearable setting stud 139 is not needed. The tensile force applied to shear threaded members 132 from the drill bit 120 will also shear threaded member 139 from the whipstock 140. Alternative means for connecting pilot lug to a whipstock exist, such as those shown in FIGS. 3, 8a, 10, 11,13,14, 16 and 38e of U.S. Pat. No. 5,887,655 issued Mar. 30, 1999 to Haugen, et al, which is incorporated herein by reference. Further, and as noted above, the connection between the drill bit 120 and the whipstock 140 may be shearably made directly (not shown) and without employing a pilot lug 130.

The pilot lug 130 is fabricated from a millable material or bearing material (e.g. bearing bronze). In one aspect, the pilot lug 130 is made of bronze.

Figure 15B:
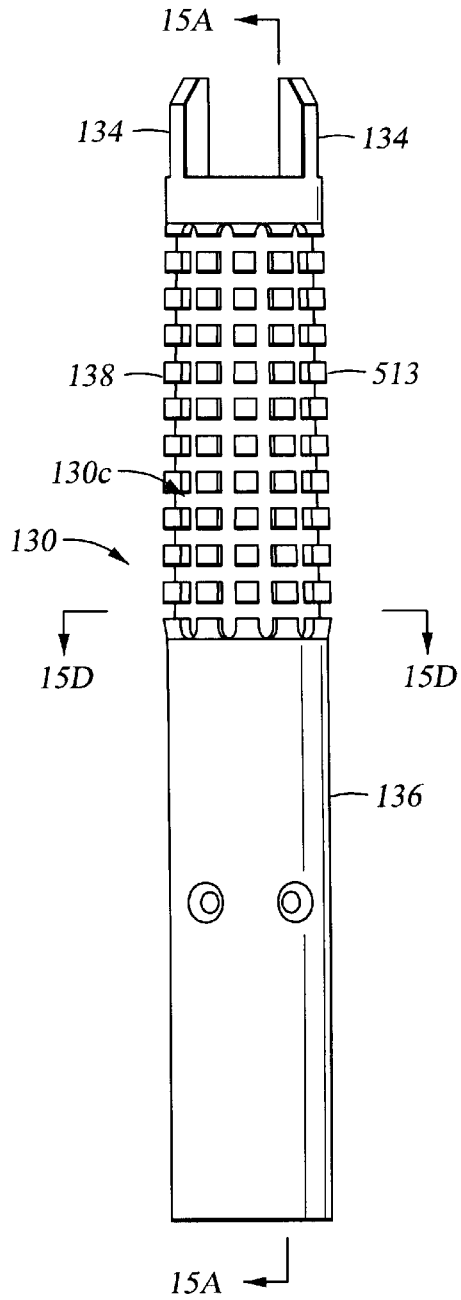
FIG. 15B is a schematic view of the convex side of the pilot lug of FIG. 15A.
Figure 15C:
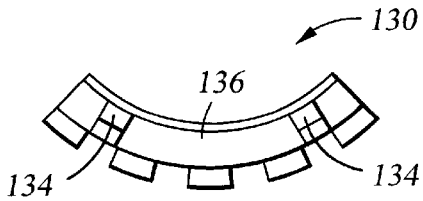
FIG. 15C is a top view of the pilot lug of FIG. 15A.
Figure 15D:
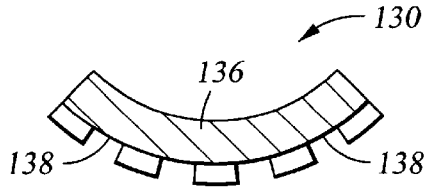
FIG. 15D is a cross-section view along line 15D—15D of FIG. 15B.

FIG. 15B depicts the pilot lug 130 of the present invention in a schematic view. In this view, the convex, or back, side 130*c* of the pilot lug 130, is shown, and the fingers 134 are more clearly seen. FIG. 15C is a top view of the pilot lug of FIG. 15A. FIG. 15D is a cross-section view along line 15D—15D of FIG. 15B.

As noted, the pilot lug 130 serves to temporarily connect the drill bit 120 to the whipstock 140. The whipstock 140 may be any known whipstock or diverter for a bit or mill. The whipstock 140 is well known in the art and includes a sloped portion 140*c* having a concave face formed therein, as also shown in FIG. 15A. The concave face 140*c* is made of material adequate to withstand abrasive action of the rotating drill 120 bit as it moves across the sloped portion towards a newly formed window in the casing to access that portion of the adjacent formation where the lateral wellbore will be formed. Within the concave face 140*c* is a bore 149 for receiving threaded setting stud 139. One or more threaded setting studs 139 may be used. In the preferred embodiment two are presented.

In conventional sidetrack drilling operations, the slope or angle of the concave face 140*c* of the whipstock 140 is quite gentle, being approximately 5–25 degrees. The reason for this low angle is to allow gradual milling of the casing as the mill (not shown) is advanced downwardly. Those skilled in the art will understand that this requires a relatively long whipstock. For the milling system 100 of the present invention, however, a shorter whipstock 140 could be employed, as the whipstock 140 does not serve as a diverter for a casing mill. Hence, the angle of diversion could be even greater than 25 degrees, so long as the drill string 110 is able to negotiate the deviation from the parent wellbore into the lateral wellbore.

Figure 16:
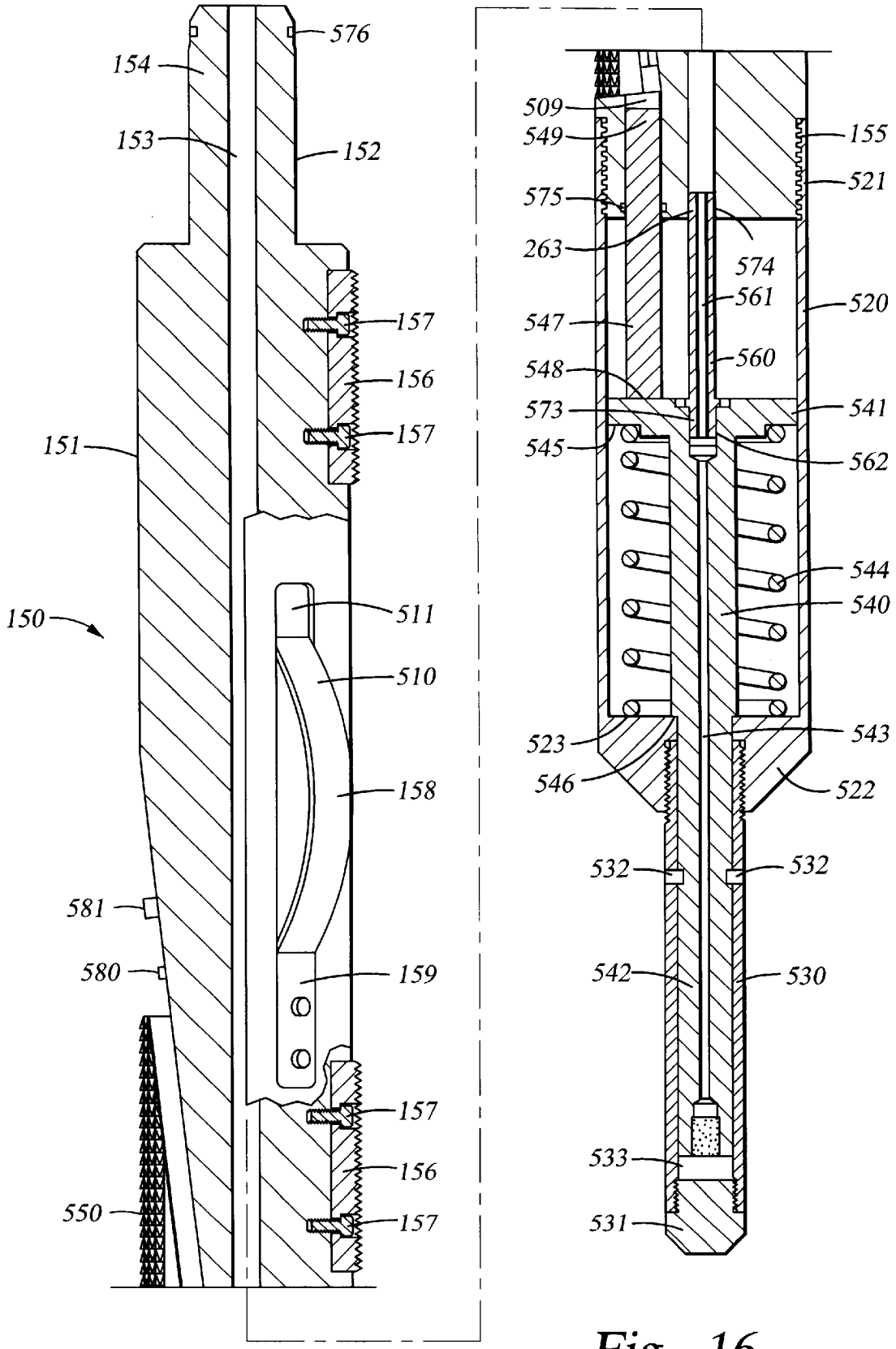
FIG. 16 is a partially cross-sectional view of an anchor assembly of the present invention.

The whipstock 140 is anchored in the casing C by an anchoring device 150, which is any known anchor, anchor-packer, packer, or setting assembly. In the preferred embodiment demonstrated in FIG. 16, the anchoring device 150 is an anchor assembly for tying into the whipstock 140 at its base. The whipstock 140 has a lower end for interconnection with the upper neck 152 of the anchor assembly In one aspect, the anchor assembly 150 as shown in FIG. 16 has a cylindrical body 151 with an upper neck 152; a fluid flow bore 153 from an upper end 154 to a lower threaded end 155; and one, two (or more) stationary slips 156 held to the body 151 with screws 157. One (or more) bow spring 158 has an end 159 screwed to the body 151 to offset the body 151 from the interior of a tubular such as casing through which the body moves to reduce wear thereon and, in one aspect, to inhibit or prevent wear on the stationary slips. The (or each) bow spring 158 has an end 510 free to move in a recess 511 as the bow spring 158 is compressed or released.

A hollow barrel assembly 520 which is cylindrical has an end 521 threadedly connected to the lower threaded end 155 of the body 151. A hollow anchor sleeve 530 is threadedly connected in a lower end 522 of the hollow barrel assembly 520. A sleeve plug 531 closes off the lower end of the hollow anchor sleeve 530 to fluid flow and is secured to the barrel assembly 520, e.g. by welding.

A piston assembly 540 is provided. The piston assembly 540 has a top piston end 541 which is mounted for movement within the hollow barrel assembly 520. The piston assembly 540 also has a lower end 542 initially projecting into the hollow anchor sleeve 530. Initially, movement of the piston assembly 540 is prevented by one or more shear screws 532 extending through the anchor sleeve 530 and into the lower end 542 of the piston assembly 540. In one aspect the shear screws 532 are set to shear in response to a force of about 5000 pounds.

A fluid flow bore 543 extends through the piston assembly 540 from one end to the other and is in fluid communication with a cavity 533 defined by the lower end surface of the piston assembly 540, the interior wall of the anchor sleeve 530, and the top surface of the sleeve plug 531. A spring 544 disposed around the piston assembly 540 has a lower end that abuts an inner shoulder 523 of the hollow barrel assembly 520 and a lower surface 545 of the piston end 541 of the piston assembly 540. Upon shearing of the shear screws 532, the spring 544 urges the piston assembly 540 upwardly. A lower shoulder 546 of the piston assembly 540 prevents the piston assembly 540 from moving any lower.

A bar 547 has a lower end 548 resting against the piston end 541 and an upper end 549 that is free to move in a channel 159 of the body 151 to contact and push up on a movable slip 550 movably mounted to the body 151 (e.g. with a known joint, a squared off dovetail joint arrangement, a dovetail joint arrangement, or a matching rail and slot configuration, e.g. but not limited to a rail with a T-shaped end movable in a slot with a corresponding shape).

Fluid under pressure for activating the anchor assembly 150 is conducted from the fluid flow bore 153 of the body 151 to the fluid flow bore 543 of the piston assembly 540 by a hollow stem 560 that has a fluid flow bore 561 therethrough from one end to the other. The hollow stem 560 has a lower end 562 threadedly secured to the piston end 541 of the piston assembly 540 and an upper end 563 which is freely and sealingly movable in the fluid flow bore 503. The fluid under pressure for actuating the anchor assembly 150 may be any suitable pumpable fluid, including but not limited to water, hydraulic fluid, oil, foam, air, completion fluid, and/or drilling mud. Those of ordinary skill in the art will understand that delivery of fluid under pressure from the surface to the anchor assembly 150 is by means of a tubing. One such arrangement of tubing is taught in U.S. Pat. No. 6,116,336 entitled "Wellbore Milling System," issued Sep. 12, 2000 to Adkins, et al. FIGS. 1–2, and Columns 7–9 of that patent are incorporated herein by reference.

A shearable capscrew 580 in the body 151 of anchor 150 initially insures that the movable slip 550 does not move so as to project outwardly from the body 151 beyond the outer diameter of the body 151 while the system is being run into a hole or tubular. In order to set the anchor assembly 150, the force with which the bar 547 contacts and moves the movable slip 550 is sufficient to shear the capscrew 580 to permit the movable slip 550 to move out for setting of the anchor assembly. Initially the capscrew 580 moves in a corresponding slot (not shown) in the movable slip 550. The slot has an end that serves as a stop member that abuts the capscrew 580 and against which the capscrew 580 is pushed to shear it. Similarly the capscrew 581 prevents the movable slip 550 from further movement out from the body 151 as the anchor assembly 150 is being removed from a wellbore and/or tubular member string. The capscrew 581 is held in and moves in a slot in the movable slip 550 and the capscrew 581 thus holds the movable slip 550. This prevents the movable slip 550 from projecting so far out from the body 151 that removal of the anchor assembly 150 is impeded or prevented due to the movable slip 550, and hence the anchor assembly 150, getting caught on or interfering with structure past which it must move to exit the wellbore and/or tubular member string.

Those skilled in the art will understand that, within the anchor assembly 150, various O-rings (e.g. made of 90 DURO nitrile) are used to seal interfaces. For example, in the preferred embodiment, an O-ring seals the interface between the upper-neck 152 of the anchor assembly 150 and the lower end of the whipstock 140. Various other features of the anchor assembly 150, are described in U.S. Pat. No. 6,116,336 entitled "Wellbore Milling System," issued Sep. 12, 2000 to Adkins, et al. FIGS. 1–2, and Columns 7–11, are again incorporated herein by reference. Other packer or anchor types may be used.

Attached to the anchor 150 is a milling device 160. In one embodiment, the milling device is a container 160 which is designed to house a quantity of an exothermic heat energy source such as thermite, and also designed to house any casing or thermite material remaining after the thermite reaction burns a hole or window in the casing wall as will be described hereafter.

Figure 17:
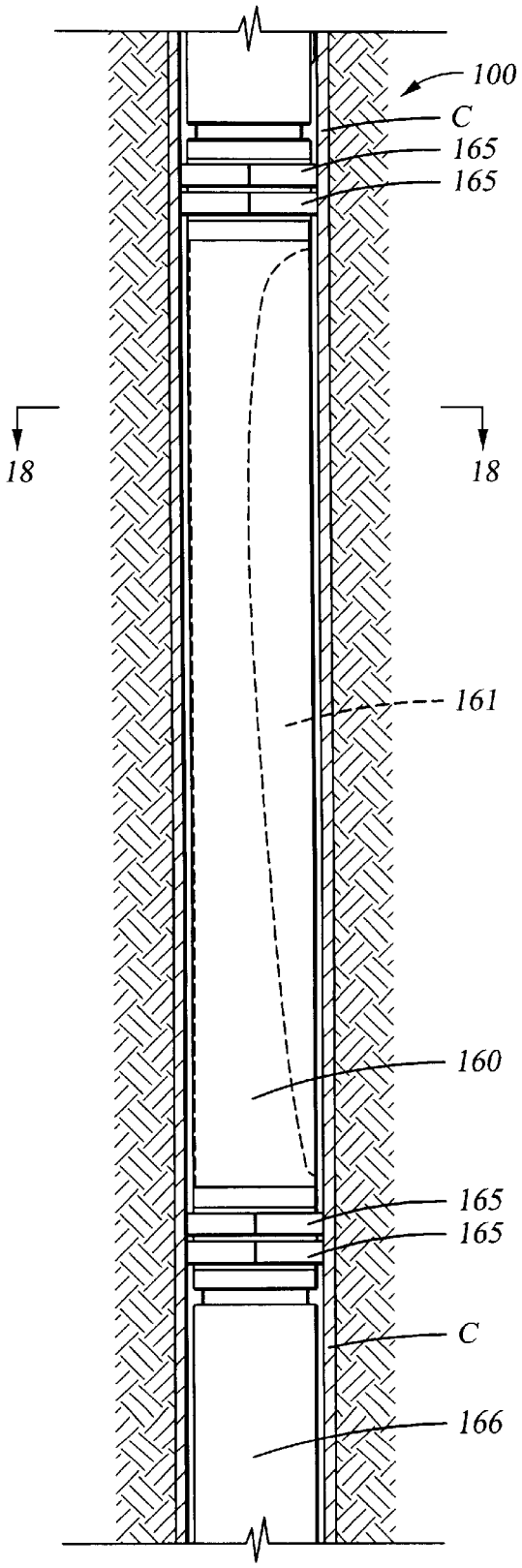
FIG. 17 is a schematic view showing a pyrotechnic milling device in a cased wellbore, with thermite material in phantom.

FIG. 17 is a schematic view showing a pyrotechnic milling device 160 in a cased wellbore. Thermite material 161, shown in dotted lines, is located along a recessed outside wall of the container portion 160 adjacent that area of the casing C where a window will be formed.

Figure 18:
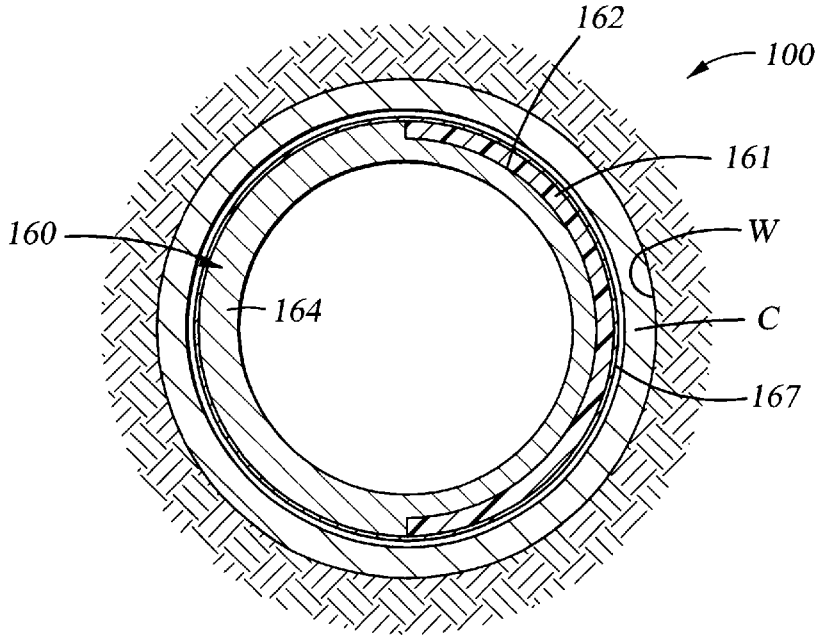
FIG. 18 is a top section view of the container portion of FIG. 17 taken along line 18—18.

FIG. 18 is a top, section view taken along a line 18—18 of FIG. 17. Visible is the wellbore, the casing C, and the thermite material 161 where the window will be formed. Thermite is housed in cavity 162 along milling device wall 164, and is held at its outer surface by a thin sheet of mesh 167 wrapped therearound. It will be appreciated by those skilled in the art that the thermite material 161 could be located and housed adjacent the casing wall in any number of ways so long as the proximity of the thermite 161 to the casing C permits the thermite process to effectively remove and displace or otherwise damage the casing material to form a window W in the casing C.

Figure 19:
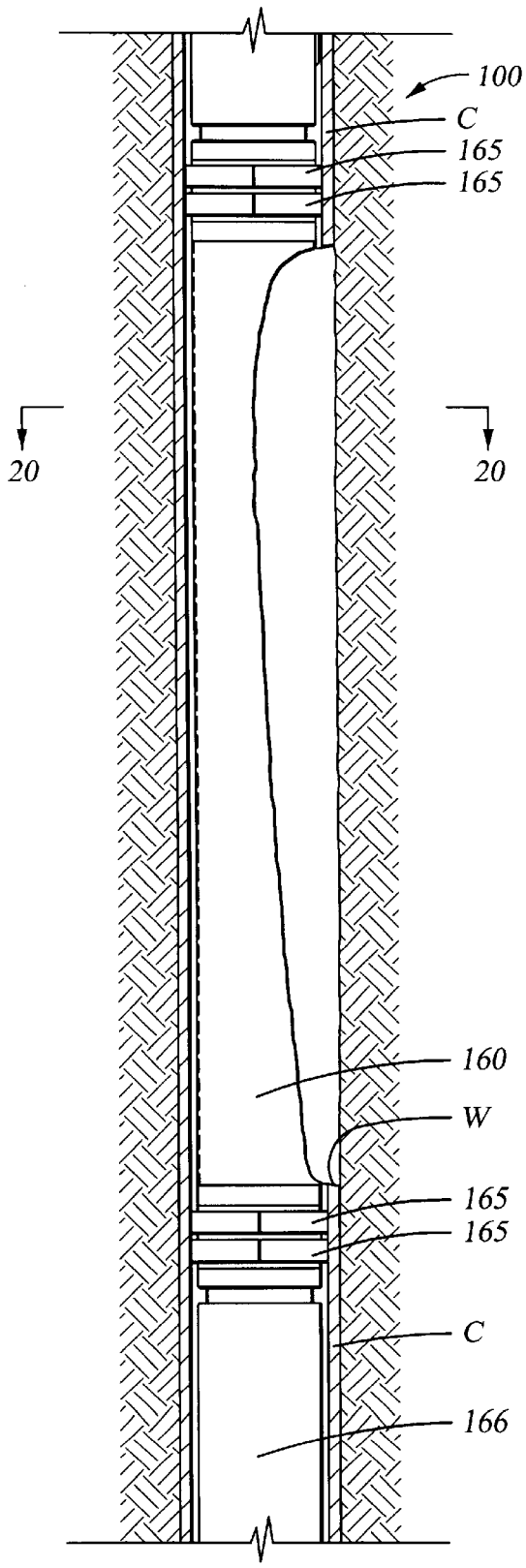
FIG. 19 is a schematic view of the pyrotechnic milling device of FIG. 17, showing a fully formed window in the wellbore casing.

FIG. 19 is a partial section view of a depicted milling device 160 in a wellbore after a window W has been formed in the casing C. As illustrated, casing C remains above and below the window W. At an upper and lower end of the milling device 160, split rings 165 are located and are designed to urge the casing material and thermite to flow into the bottom of the container portion 166 as it melts and also to remove any remaining material on the inside of the window opening as the milling device 160 moves down across the window W after the window W is formed, as will be more fully disclosed herein.

Window W is formed through a thermite process, including an exothermic reaction brought about by heating finely divided aluminum on a metal oxide, thereby causing the oxide to reduce. Thermite is a mixture of a metal oxide and a reducing agent. A commonly used thermite composition comprises a mixture of ferric oxide and aluminum powders. Upon ignition, typically by a magnesium ribbon or other fuse, the thermite reaches a temperature of 3,000° Fahrenheit, and up to 3800° Fahrenheit, sufficient to soften steel and cause it to flow. Those skilled in the art will understand that steel, as the primary component within the casing C, will begin to melt at about 1800° to 2000° Fahrenheit.

Figure 20:
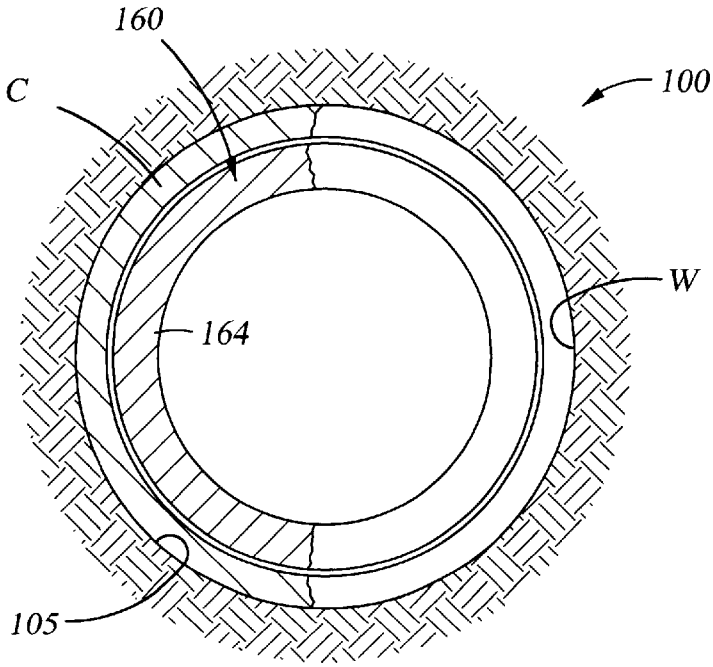
FIG. 20 is a section view of the container portion taken along a line 20—20 of FIG. 19 showing a section of the container wall and casing wall removed by exothermic means.

FIG. 20 is a top, section view taken along a line 20—20 of FIG. 19. Visible in FIG. 20 is the milling device 160 of the system 100 after the window W has been formed in the wall of the casing C. Visible on the left side of the FIG. 20 is casing C and disposed annularly therein, the undamaged wall 164 of the milling device 160. Visible on the right side of the drawing, the wall 164 of the milling device 160 and the casing C have been removed by the thermite process, leaving the interior of the milling device 160 exposed to the formation through window W.

The size of window W is dependent upon the amount of thermite 161 used and the extent of application of the thermite 161 laterally against the casing C. Several applications of ignited thermite 161 at offset depths will produce a larger window W. Offset depths may be reached by raising or lowering the drill string 110 during this milling process.

Figure 21:
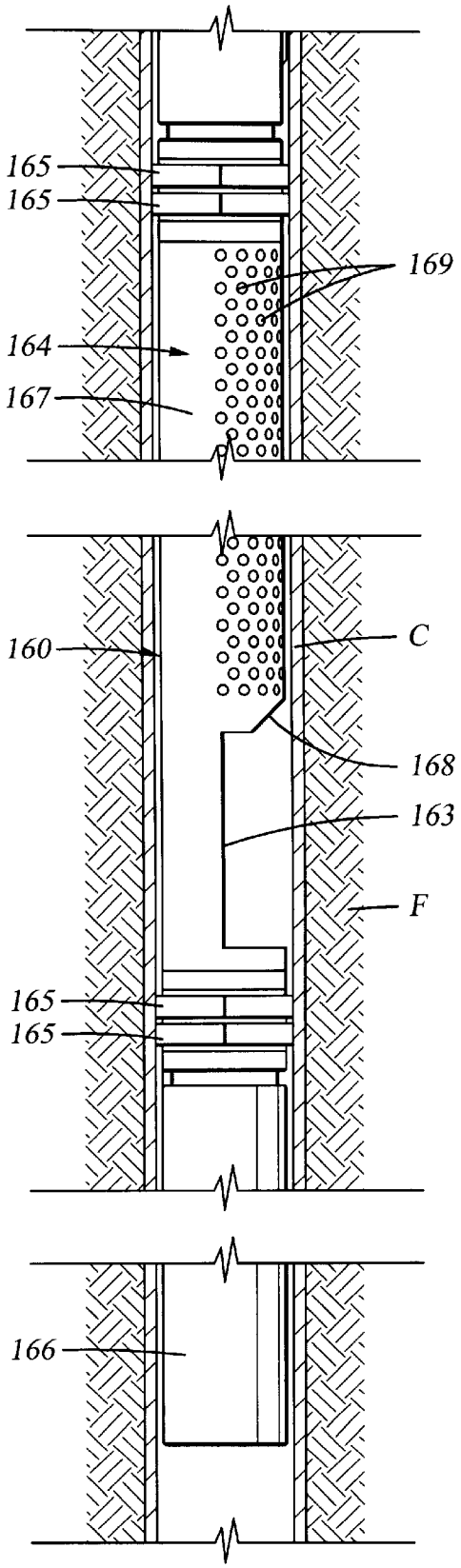
FIG. 21 is a schematic view of an embodiment of a pyrotechnic milling device for use in the present system, illustrating a container portion.

One embodiment of a milling device 160 of the present invention is shown in the plan view of FIG. 21. In this embodiment, the milling device 160 has a container portion 164 which includes a wall 167 having apertures 169 therethrough. In this embodiment, the thermite material 161, located inside the container portion 164, causes destruction of the adjacent wellbore casing C without destroying the wall 167 of the container 164. The wall 167 of the container 165 is formed of ceramic material or some other material resistant to the heat created by the burning thermite 161. As shown in FIG. 21, the container portion 165 is extended in length to include a lower portion 166 having an opening 163 constructed and arranged to receive spent thermite and casing material as the thermite process is completed and a window is formed in the casing.

Figure 22:
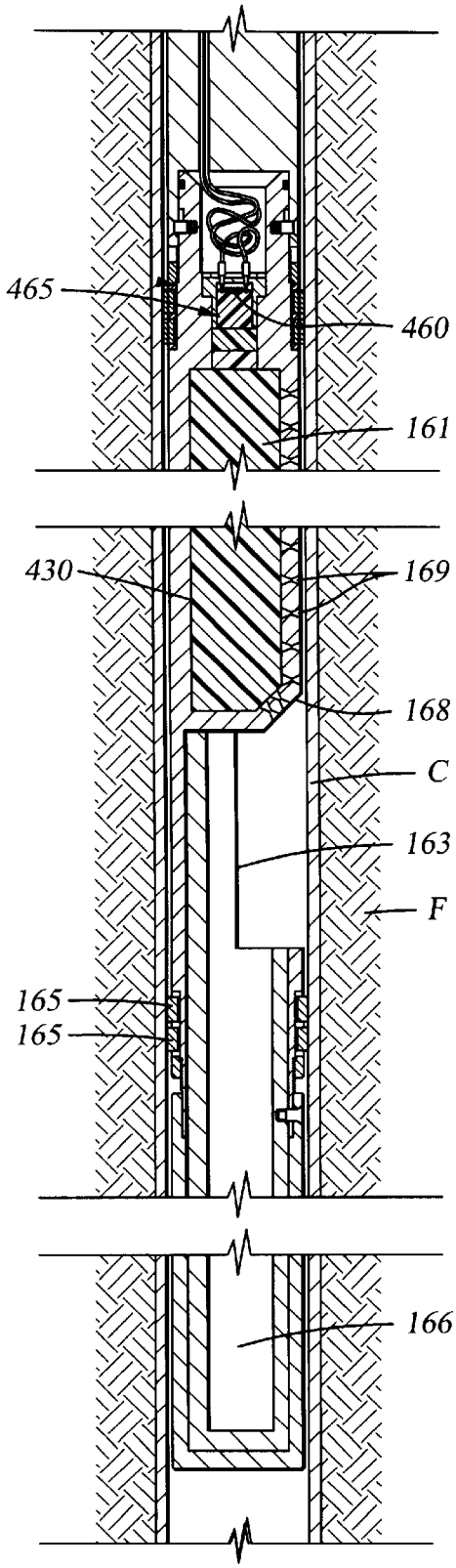
FIG. 22 is a section view of the pyrotechnic milling device of FIG. 21.

FIG. 22 is a section view showing the thermite material 161 in the interior of the container portion 164 as well as the shape of the apertures 169 formed in the container wall 167. Each aperture 169 includes a converge/diverge portion whereby during the thermite process, burning thermite 161 is directed through each aperture 169 where the velocity of the thermite 161 increases in the converge portion. A diverge portion at the outer opening of each aperture 169 allows the burning thermite to exit the container wall 167 in a spray fashion giving a sheet effect to the burning thermite as it contacts and melts the casing C. The container portion 164 includes a slanted face 168 also having apertures 169 formed therein. The shape of the slanted face 168 permits a pathway for flowing thermite 161 and casing material into the opening 163 therebelow. Also visible in FIG. 22 is a thermite initiator assembly 465 relying upon an electrical signal to begin the thermite process.

Figure 23:
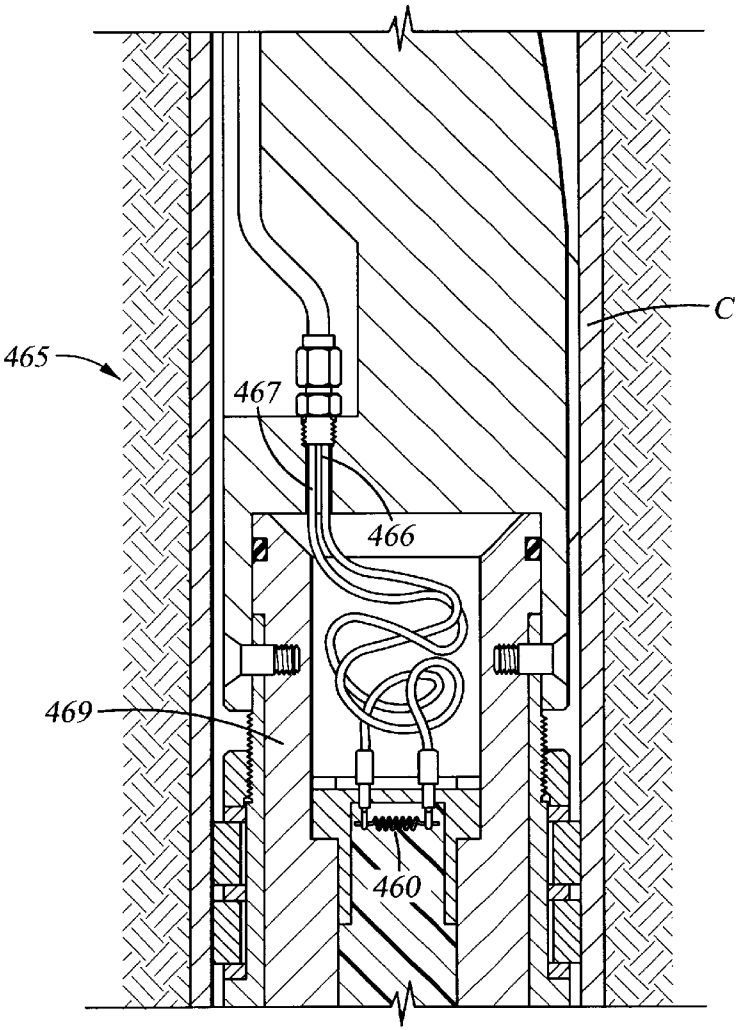
FIG. 23 is a section view illustrating apparatus for initiating the thermite process in the pyrotechnic milling device of FIG. 21.
Figure 26:
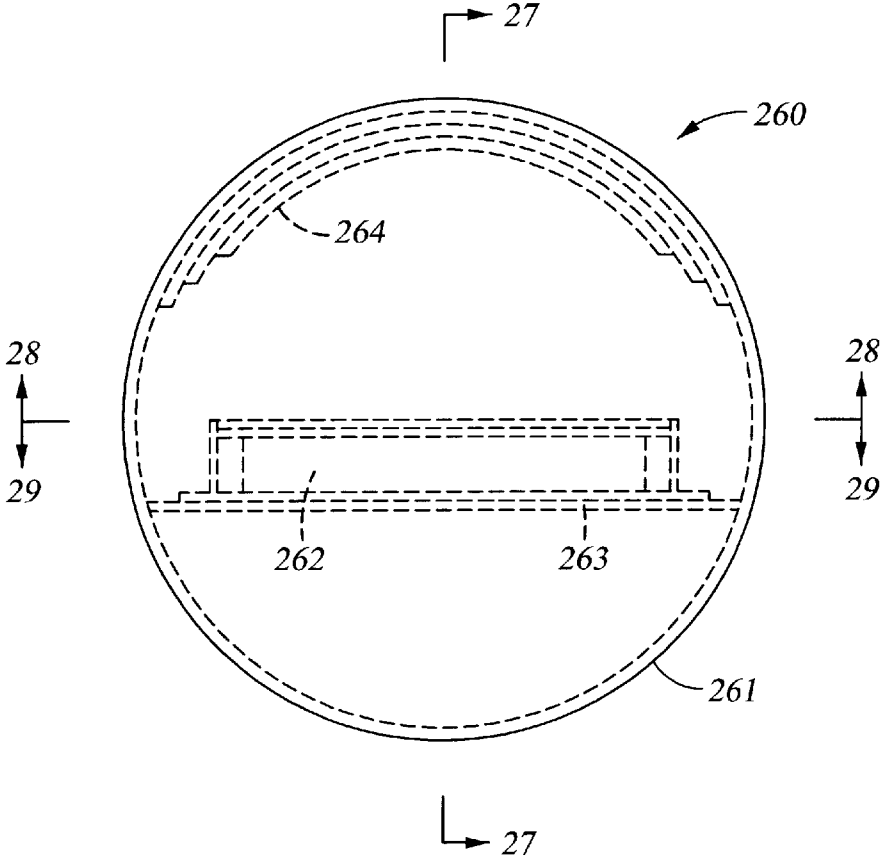
FIG. 26 is a top cross-section view of an explosive device useful in the system of FIG. 1.

FIG. 23 is a section view more clearly showing an electrical assembly 465 for initiating the thermite process. The electrical assembly 465 includes two electrical conductors 466, 467 extending from the surface of the well and attached to an electrode 460 therebetween in a housing 469 of the thermite initiator 465. At a predetermined time, an electrical signal is supplied from the surface of the well and the electrode 460 rises to a temperature adequate to initiate burning of thermite 161 located proximate the electrode 460. Subsequently the thermite 161 in the wall 167 of a container portion 164 burns to form the window in the casing C. As the thermite process takes place, thermite 161 and casing material flow down into the opening 163 and are captured in the lower portion 166 of milling device 160.

The above described system 100 for milling a window in wellbore casing and then drilling a lateral wellbore therethrough represents but one embodiment for such a system. Other embodiments exist which are within the scope of the present invention, including assemblies for utilizing chemicals other than thermite as a means for milling casing. In this regard, any chemical capable of degrading steel casing through a melting, oxidizing, or vaporizing action may be employed.

Figure 24:
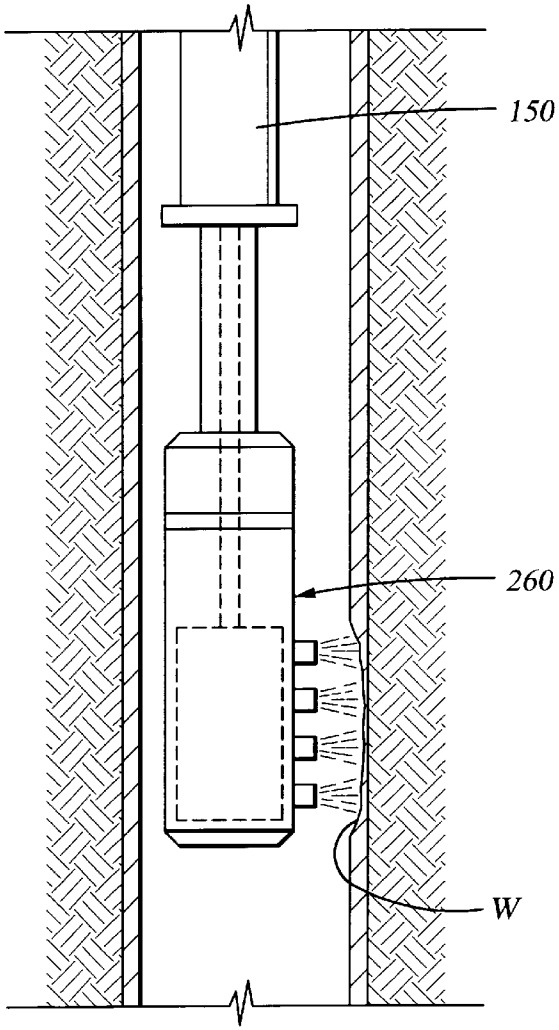
FIG. 24 is a schematic view of an explosive charge milling device forming a window in casing.

In addition, various embodiments of the milling device 160 may be employed which do not involve the application of chemicals against the surface of a portion of casing. One such other embodiment of the milling device 160 is the use of a shaped charge of explosive. To produce such a charge of explosive, it should be understood that any suitable explosive device may be used, including but not limited to: a jet charge, linear jet charge, explosively formed penetrator, multiple explosively formed penetrator, or any combination thereof. One embodiment for an explosive charge is shown schematically in FIG. 24, which presents a perforating gun 260 lowered into the primary borehole, and suspended from the anchor 150. The perforating gun 260 is positioned at the depth that corresponds to the desired depth of the window W. Those skilled in the art will understand that the perforating gun 260 includes a detonator device (not shown) for initiating the firing of the perforating gun 260. The details of a suitable detonator device are shown in Columns 4–5 and 8–11 in U.S. Pat. No. 5,791,417, entitled "Tubular Milling Formation," issued on Aug. 11, 1998 to Haugen, et al., the disclosure of which is incorporated herein by reference.

Figure 25:
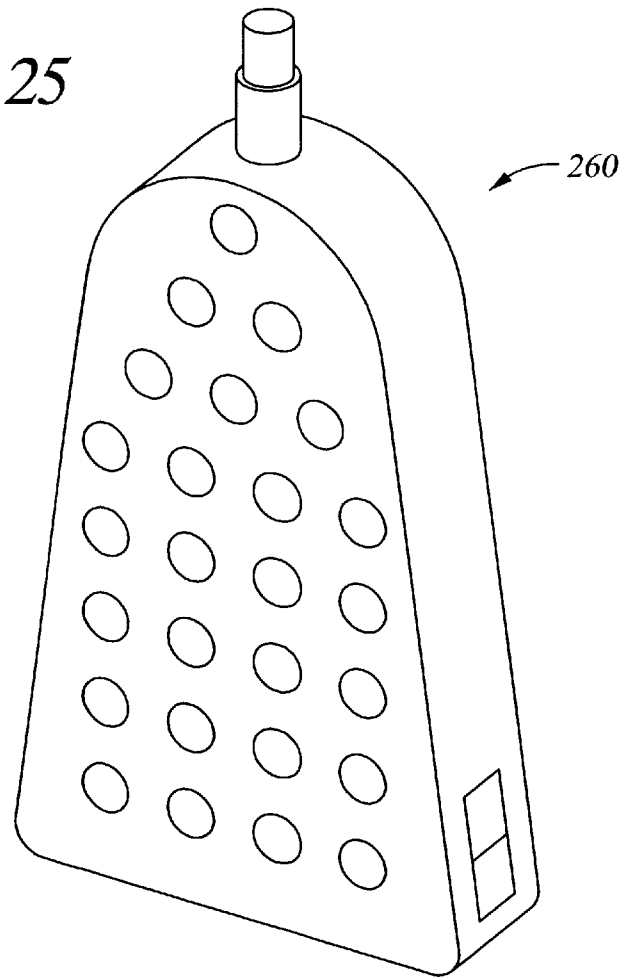
FIG. 25 is a perspective view of an alternate embodiment of a milling device for use in the milling system of the present invention. This view presents a shaped charge as the milling device.
Figure 27:
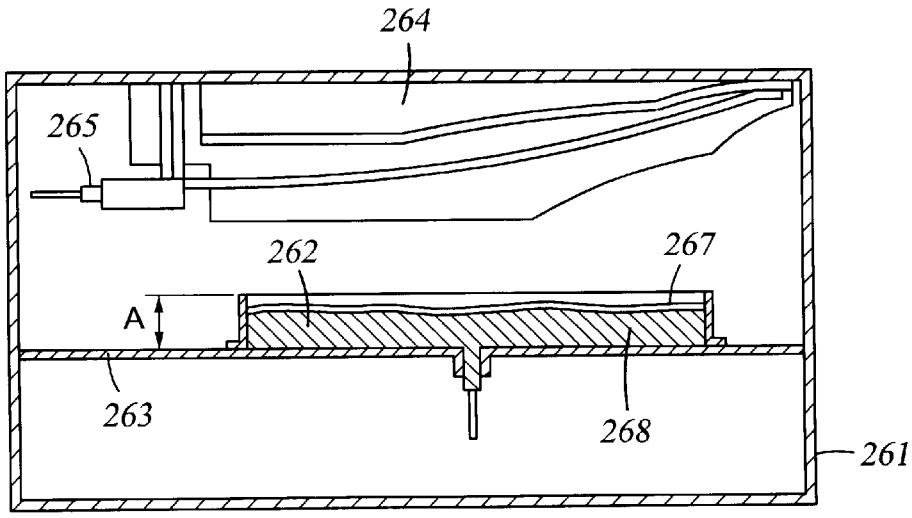
FIG. 27 is a cross-section view taken along line 27—27 of FIG. 26.
Figure 28:
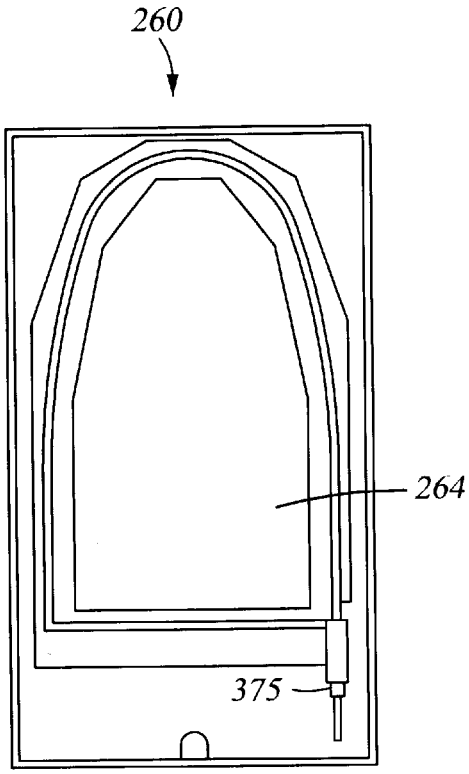
FIG. 28 is a cross-section view along line 28—28 of FIG. 26.
Figure 29:
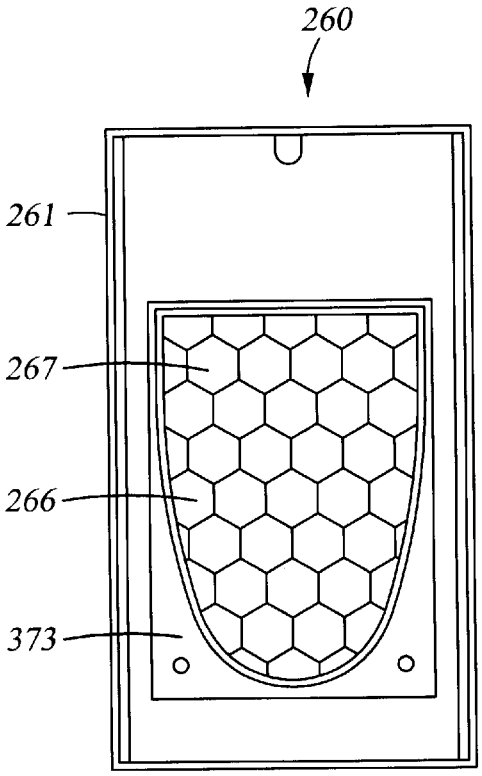
FIG. 29 is a cross-section view along line 29—29 of FIG. 26.

Perforating guns exist in a variety of shapes and sizes. FIG. 25 depicts one possible configuration for a perforating gun to be used as the milling device 160 of the present system 100. The perforating gun 260 produces a charge useful for perforating a window W.

FIGS. 26–29 demonstrate the charge within the perforating gun 260 of FIG. 25. A main explosive charge 262 secured to a plexiglass plate 263 is mounted in the housing 261. A linear jet explosive charge 264 with a booster detonator 265 is also mounted in the housing 261. The distance "a" in FIG. 27 in one embodiment is about 1.35 inches (3.43 cm).

The main explosive charge 262 includes a liner 267 with a series of hexagonal discs 266 of explosive each about 0.090 inches thick. The discs 266 are, in certain embodiments, made of metal, e.g. zinc, aluminum, copper, brass, steel, stainless steel, or alloys thereof. A main explosive mass 268 is behind the discs 266. In one aspect this explosive mass is between about one half to five-eights of a kilogram of explosive, e.g. RDX, HMX, HNS, PYX, or C4. In one aspect the liner 267 is about 8.64 inches (21.94 cm) high and 5.8 inches (14.73 cm) wide at its lower base.

Preferably the linear jet charge 264 is formed and configured to "cookie cut" the desired window shape in the casing and then the main charge 262 blows out the window preferably fragmenting the casing and driving it into the formation. By appropriate use of known timers and detonation cord, the linear jet charge can be exploded first followed by the main charge. Alternatively the two charges can be fired simultaneously.

The perforating gun 260 is fired a sufficient number of times in the direction of the casing C as to substantially open up a window W. In order to assure a substantially complete aperture for drilling through the casing, the depth and orientation of the perforating gun 260 is adjusted between shots. This is accomplished by raising and lowering the drill string 110, thereby assuring that virtually each shot is fired into an intact portion of casing C until no substantially intact portion remains.

At any location in the system 100 appropriate known explosive shock attenuation devices (not shown) may be employed, including but not limited to materials having varying sound speeds, (e.g. a sandwich of rubber-plastic-rubber-plastic) and collapsing atmospheric chambers. Such devices may be placed above or below the charge or between the charge and any other item in the system, e.g. the whipstock.

Figure 30:
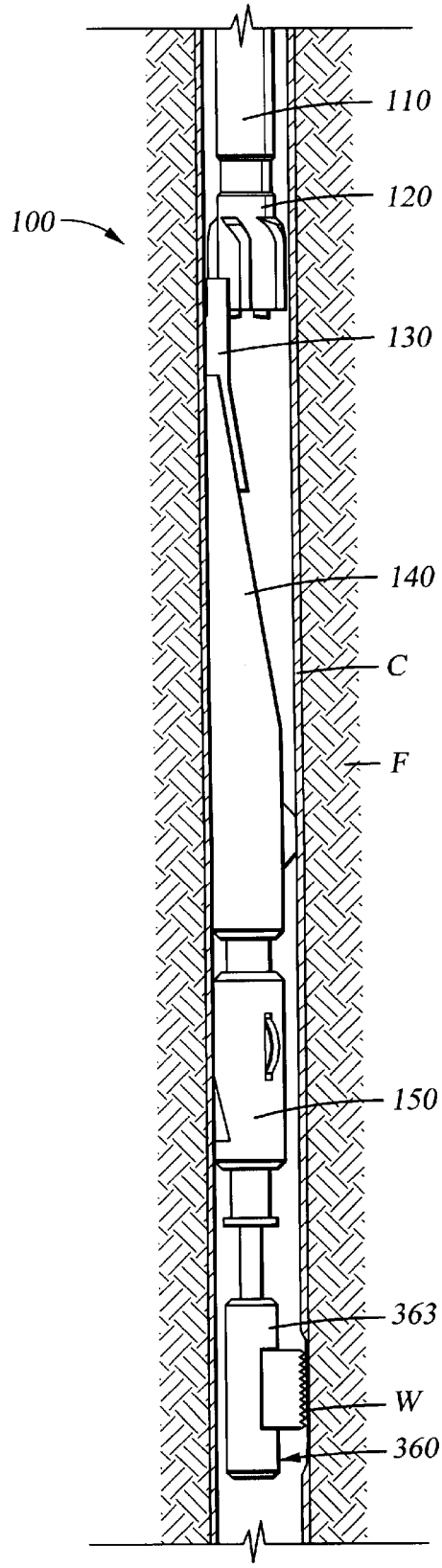
FIG. 30 is a schematic view of the system of the present invention wherein the milling device is a reciprocating broach.

Still another embodiment for the milling device 160 is a reciprocating mill which serves as a broach. FIG. 30 depicts schematically the system 100 of the present invention utilizing a broach 360 as the milling device. The broach 360 operates to mechanically mill a window W into casing C. In the preferred embodiment, the broach 360 operates to cut an opening into a portion of the casing C. The broach 360 can be any type of broach, including a square, hexagon, serration, straight or involute splines, round body keyways, standard keyways, or other form of broach capable of mechanically cutting away steel casing from inside.

Figure 31:
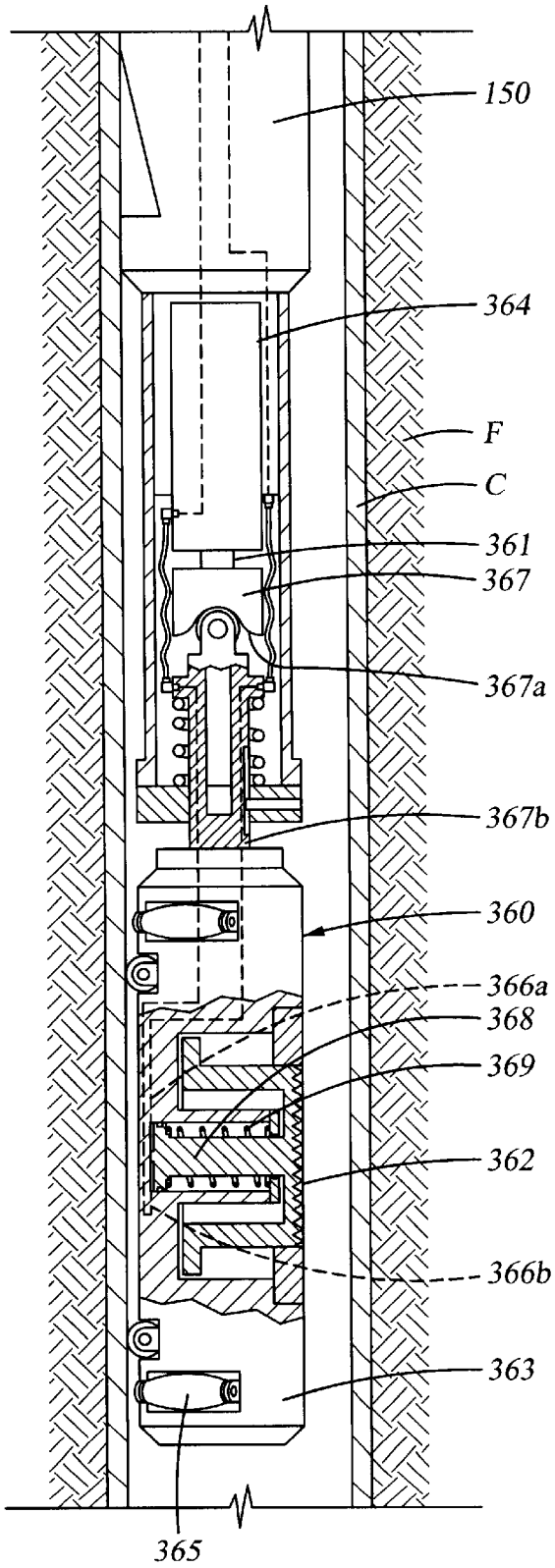
FIG. 31 is a side view of the anchor and reciprocating broach of the system of the present invention, with the reciprocating broach shown in cross-section.

In the preferred embodiment for the present invention, the broach 360 employs serrated teeth 362 for milling. The teeth 362 are positioned at the distal end of a fluid actuated piston 368. In its dormant state, the piston 368 resides within the broach 360. As depicted in FIG. 31, the piston 368 is biased to remain within the housing 363 of the broach 360 by a spring 369. In this manner, the teeth 362 do not come into contact with the casing C until the drill string 110 is fully run and the broach 360 is activated. Once the drill string 110 is run to the appropriate depth, the piston 368 is activated so as to extrude the piston 368 out of the housing 363. This, in turn, forces the teeth 362 against the inside wall of the casing C.

In the preferred embodiment, the piston 368 is forced out of the housing 363 by hydraulic pressure on the piston 368 opposite the teeth 362. Hydraulic pressure is supplied by a hydraulic intake line 366*a* in an amount sufficient to overcome the compression strength of the spring 369. The hydraulic intake line 366*a* is shown in both FIGS. 31 and 32 in phantom.

Figure 32:
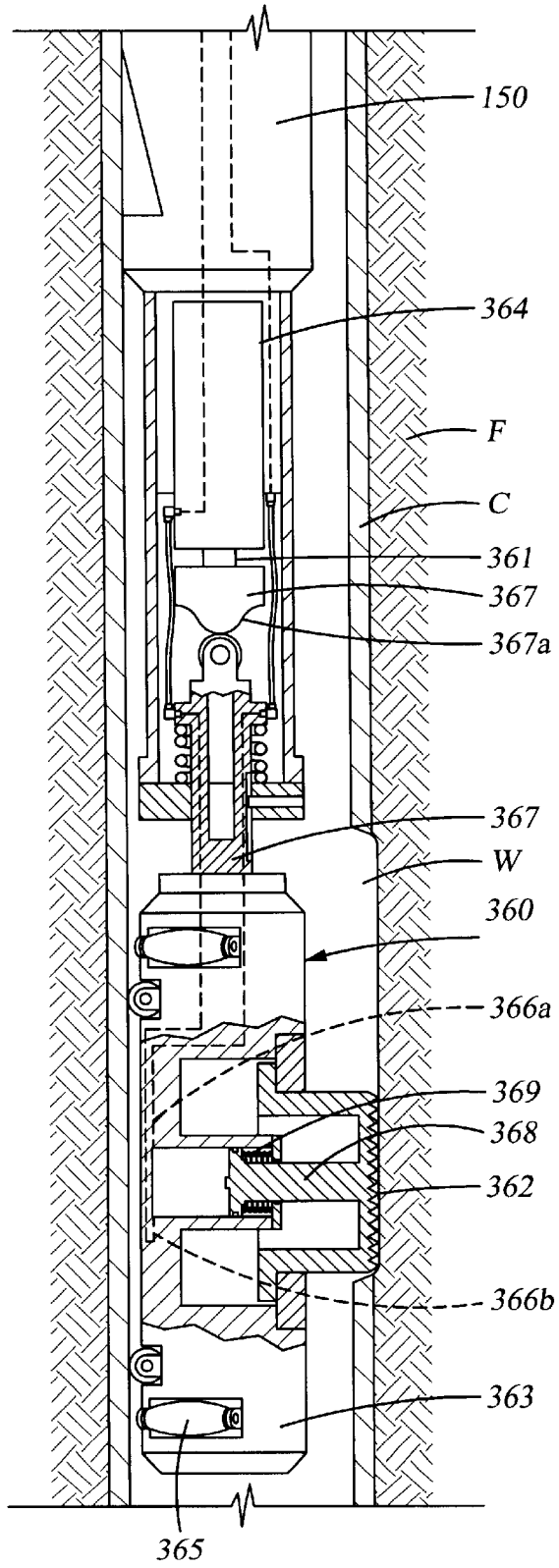
FIG. 32 presents the reciprocating broach of FIG. 31, having milled a portion of casing.

In FIG. 31 the broach 360 is in its dormant state. In FIG. 32, pressure has been supplied to the hydraulic line 366*a* such that the teeth 362 of the broach 360 have engaged the casing C.

To form a window W of sufficient size for drilling a lateral wellbore, the broach 360 must be translationally moved within the wellbore. This can be accomplished by raising and lowering the drill string 110 so as to abrade the teeth 362 of the broach 360 against the casing C. Abrasion is applied along a sufficient length of the casing C as to form a complete window W.

Alternatively, and as depicted in FIG. 31, the broach 360 can be reciprocated by use of a rotary motor 364. The rotary motor 364 includes a drive shaft 361 which rotates a cam 367. The cam 367 has a wave form, e.g., sinusoidal, face 367*a* which turns rotational movement of the drive shaft (not shown) into axial movement. In this regard, the sinusoidal face 367*a* of the cam 367 acts upon a vertical plunger 367*b* to cause the broach to reciprocate vertically. Such an arrangement is previously taught in FIGS. 1 and 2 of U.S. Pat. No. 5,042,592 in the context of a hand-held power tool. The '592 patent, entitled "Power Tool," allows a bit to be reciprocated mechanically while the hand tool is in operation. Columns 1–4 of the '592 patent are incorporated herein by reference.

Figure 33:
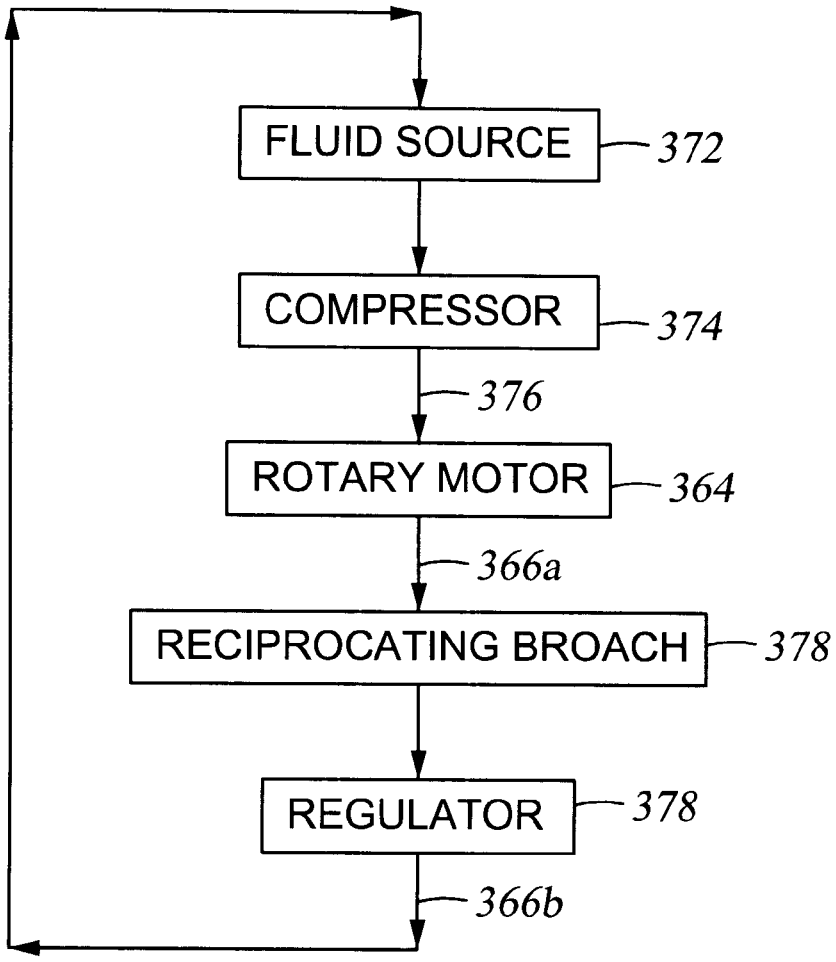
FIG. 33 is a schematic view of a fluid system of the present invention, used to activate the reciprocating broach embodiment.

The rotary motor 364 in one aspect is hydraulically powered. FIG. 33 schematically depicts the fluid powering system 370 for the reciprocating broach 360. The fluid powering system 370 first provides a fluid source 372 which resides outside of the wellbore. The fluid is typically drilling mud. However, those skilled in the art will understand that other fluids may be utilized. Fluid is run through a compressor 374 which pumps fluid to the motor 364 by means of a fluid source line 376.

Fluid exits the rotary motor 364 through fluid intake line 366*a*. Fluid intake line 366*a* delivers fluid to the housing 363 of the reciprocating broach 360. More specifically, fluid is delivered to the back side of the piston 368 so as to urge the piston 368 out of the housing 363 and against the inner wall of the casing C.

Fluid exits the housing 363 of the reciprocating broach via fluid outtake like 366*b*. Fluid is then returned to the fluid source 372 to complete circulation.

A means for providing pressure to the fluid powering system 370 is needed. Pressure is needed both to activate the motor 364 and to extrude the piston 368 from the housing 363 against the casing C. Accordingly, a regulator 372 is placed in outtake line 366*b*. The regulator 372 may take several forms. In one aspect, the regulator 372 is a valve having a pressure gauge (not shown) for variably regulating pressure. Alternatively, the regulator 372 may simply be a sized orifice by which fluid connection between the housing 373 and fluid outtake line 366*b* is made.

In the preferred embodiment, the rotary motor 364 and piston 368 are activated by the same fluid power system 370. The motor 364 is set to activate at a preset pressure. Where the regulator 372 is a sized orifice, the orifice is sized such that the motor 364 is activated when critical flow through the sized orifice is reached.

In the preferred embodiment, the pressure needed to extrude the piston 368 out of the housing 363 will be less than the critical pressure which actuates the rotary motor 364. In this manner, the broach 360 is not reciprocated until the piston 368 has been extruded from the housing 363 and urged against the casing C.

To facilitate the vertical movement of the broach 360 within the wellbore, rollers 365 are optionally incorporated into the housing 363 of the broach 360. The rollers 365 are placed into the housing 363 opposite the teeth 362. The rollers 365 are disposed along the housing 363 horizontally so as to facilitate vertical movement of the milling device 360 within the wellbore 100.

To further aid abrasion of the casing, the tubular 110 may be optionally partially rotated during broaching. In this manner, a wider window W is formed. However, it is preferable that the broach be configured to have an arcuate face having a radius to conform to the desired size of the window W. Thus, rotation of the tubular 110 would not be necessary.

The milling device 360 of FIG. 31 and FIG. 32 represents but one embodiment of a reciprocating milling device. It is within the scope of the methods of the present invention to utilize any reciprocating milling device. For example, a reciprocating milling device having a mill mounted on a right angle drive mechanism (not shown) could be employed. Such a device would employ a motor which turns a shaft. The motor shaft is suspended from the motor at its top end so as to be in axial alignment with the wellbore. The motor shaft has a first gear set at its bottom end. Thus, the first gear set is rotated when the motor rotates the motor shaft. Activation of the motor would be through a fluid system such as the one described above in connection with FIG. 31 and FIG. 32.

In the alternate embodiment defining a right angle drive mechanism, a broach shaft is disposed in the wellbore perpendicular to the motor shaft. At one end of the broach shaft is a second gear set which is in mechanical communication with the first gear set. In this respect, each gear set includes an angled face having gear members which interlock so as to transfer movement from the first gear to the second. Rotation of the first gear set by the motor will thus turn the second gear set. This in turn, rotates the broach shaft.

At the end of the broach shaft opposite the second gear set is a broach. In this embodiment, the broach also includes a series of teeth. However, this broach is generally circular in configuration, accommodating rotation by the broach shaft. The window W is milled through the casing C in this embodiment by the rotation of the broach shaft. Thus, the casing C is mechanically cut upon rotation of the broach shaft, thereby creating the window W.

The right angle drive mechanism embodiment for a broaching device 360 optionally includes means for extending the broach into greater frictional contact with the inner casing C surface. For example, a generally conical configuration is used for the faces of the first and second gear sets, with gears disposed around the conical faces. Extension of the motor shaft downward forces the conical face of the second gear set outwardly, thereby forcing the broach against the casing C.

Figure 34:
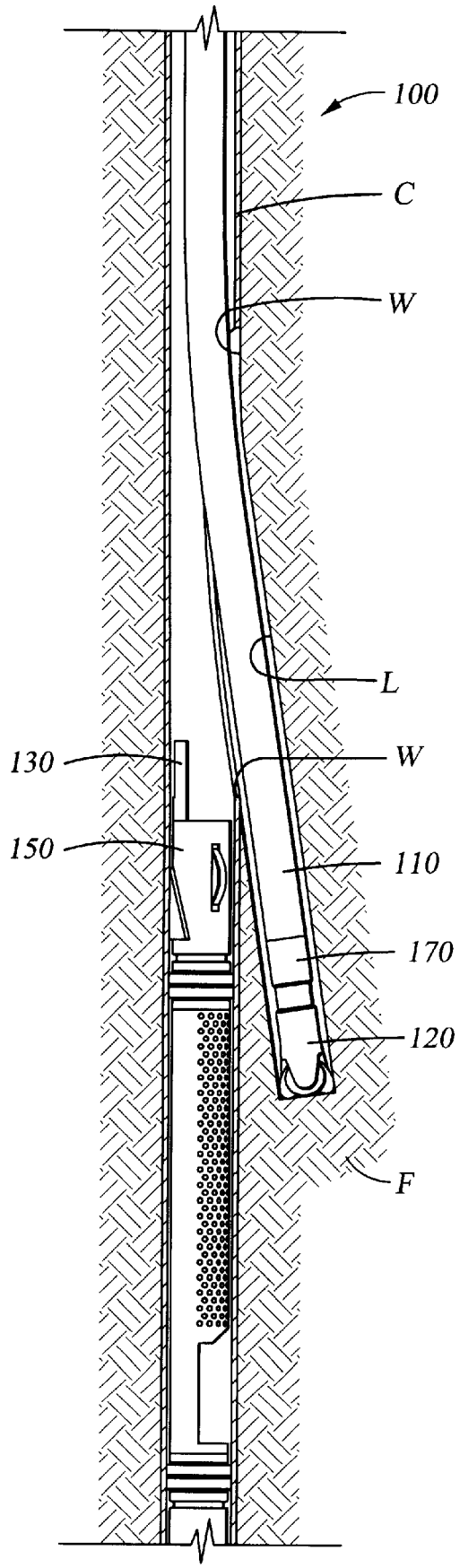
FIG. 34 is a section view demonstrating a drill string and drill bit drilling a sidetrack hole, and also showing a steerable drilling device for directionally controlling the exit of the drill bit from a central wellbore and sidetrack drilling operation.

In the system 100 of the present invention, and unlike prior art systems, the anchor is not set until after the casing C is milled. After the window W has been completely milled, the drill string 110 is lowered so as to position the whipstock 140 relative to the window W. FIG. 34 is an elevation view of the system 100 illustrating the whipstock 130 in the wellbore W at a location adjacent the newly formed window W in the casing C. Once the whipstock 130 is properly positioned according to depth and azimuth in the wellbore W, the anchor 160 is activated. The anchor-whipstock's orientation is checked by running a tool such as a gyroscope indicator (not shown) into the wellbore.

Once the anchor 160 is set, drill bit 120 must be freed from the temporary connection with the whipstock 140. To effectuate separation, and as disclosed above, and, optionally, a compressive force or tensile force is applied between the drill bit 120 and the whipstock 140. This is accomplished by pulling and/or pushing on the drill string 110 to apply the predetermined stress necessary to shear the setting studs 131 and 132. Thereafter, the drill bit 120 can be lowered, rotated and extended along the sloped portion 140*c* of the whipstock 140 and through the window to form a lateral wellbore L. The process of drilling along the whipstock 140 will cause the pilot lug 130 to be mulched by the drill bit 120.

Finally, FIG. 34 demonstrates the result of the milling system 100, that being a window W formed in casing C with a drill string 110 now drilling a lateral borehole L. FIG. 34 also presents a steerable drilling device 170 for directionally controlling the sidetrack drilling operation. This represents yet another emerging technology offering a savings of time and expense in drilling and creating wellbores. A rotary steerable drilling system 170 allows the direction of a wellbore L to be changed in a predetermined manner as the wellbore L is being formed. For example, in one well-known arrangement, a downhole motor (not shown) having a joint, or bent sub within the motor housing can create a slight deviation in the direction of the wellbore L as it is being drilled. In use, the direction of drilling is changed when the orientation of the joint is changed from the surface of the well. Additionally, the steerable drilling device can direct a drill bit through a preformed opening or window in casing.

Another means of directional drilling includes the use of rotary steerable drilling units (not shown) with hydraulically operated pads (not shown) formed on the exterior of a housing near the drill bit. The mechanism relies upon a MWD device (measuring while drilling) (not shown) to sense gravity and use the magnetic fields of the earth. The non rotating pads are able to extend axially to provide a bias against the wall of a borehole or wellbore and thereby influence the direction of the drilling bit therebelow. Rotary steerable drilling is described in U.S. Pat. Nos. 5,553,679, 5,706,905 and 5,520,255 and those patents are incorporated herein by reference in their entirety.

Any of the forgoing devices are capable of directing a milling tool from a central wellbore through a window in casing to begin the formation of a lateral wellbore, without the use of a diverter.

While the foregoing is directed to some embodiments of the present invention, other and further embodiments of the invention may be devised without departing from the basic scope thereof, and the scope thereof is determined by the claims that follow.

What is claimed is:

1. A method of forming a lateral wellbore from a cased wellbore, comprising the steps of:

running an apparatus into the wellbore to a predetermined location, the apparatus comprising a tubular string, a drill bit attached to the tubular string, a diverting device below the drill bit, and an aperture forming device disposed below the diverting device for creating an aperture in the wellbore casing;

activating the aperture forming device to create the aperture in the casing;

directing the drill bit through the aperture; and drilling the lateral wellbore.

2. The method of claim 1, wherein the diverting device is a whipstock.

3. The method of claim 1, wherein the diverting device is a rotary steerable drilling device.

4. The method of claim 3, wherein the diverting device is a bent sub.

5. The method of claim 1, wherein the apparatus further comprises an anchoring device also disposed below the diverter device; and the method further comprises the step of setting the anchoring device within the cased wellbore before the step of drilling the lateral wellbore.

6. The method of claim 1, wherein the apparatus further comprises a lug having a body and an upper end, the upper end of the lug being temporarily connected to the drill bit, the body of the lug is connected to the diverter, and the lug is fabricated from a material capable of being comminuted by the drill bit.

7. The method of claim 6, wherein the connection between the drill bit and the diverter is a shearable connection that fails upon application of a predetermined force between the diverter and the drill bit.

8. The method of claim 1, wherein the aperture-forming device applies a chemical to the wellbore casing to form the aperture.

9. The method of claim 8, wherein:

the aperture-forming device defines a container having an exothermic heat source material for melting casing in order to form the aperture therein, and an initiator for initiating combustion of the heat source material; and the step of activating the aperture forming device defines the step of initiating combustion of the exothermic heat source material, thereby causing the heat source material to be expelled from the container and to be applied against the casing, and melting casing material to form the aperture.

10. The method of claim 9, wherein the exothermic heat source material is thermite.

11. The method of claim 1, wherein the aperture-forming device is a perforating gun.

12. The method of claim 11, wherein the perforating gun delivers an explosive charge; and the step of activating the aperture forming device defines the steps of positioning the perforating gun at varying depths within the casing and firing the perforating gun in a selected direction such that a plurality of explosive charges are administered to create the opening in the wellbore casing.

13. The method of claim 1, wherein the aperture-forming device defines a broach for mechanically cutting casing.

14. A method for forming a lateral borehole from a parent wellbore, the parent wellbore being lined with casing, the method comprising the steps of:

running an apparatus into the parent wellbore, the apparatus comprising a tubular string, a drill bit in fluid communication with the tubular string at a lower end thereof, a diverter releasably connected to the drill bit, and a milling device;

lowering the apparatus such that the milling device is located at a predetermined depth and orientation in the parent wellbore;

activating the milling device to form a window through the casing of the parent wellbore at the predetermined depth and orientation;

repositioning the apparatus such that the diverter is adjacent to the window in the parent wellbore and is oriented to divert the drill bit towards the window in the casing;

releasing the drill bit from the diverter;

urging the drill bit downwardly against the diverter; and rotating the drill bit through the window in order to form the lateral borehole.

15. The method of claim 14, wherein the milling device defines a container having an exothermic heat source material for melting casing in order to form the window therein, and an initiator for initiating combustion of the heat source material, and the activating step defines the step of initiating combustion of the exothermic heat source material, causing the heat source material to be expelled from the container and to be applied against the casing, thereby removing melted casing material and forming the window.

16. The method of claim 15, wherein the container defines:

an outer wall;

a first interior space within the outer wall for containing the exothermic heat source material before combustion;

at least one aperture formed in the outer wall, the at least one aperture forming a path of communication between the exothermic heat source material within the first interior space, and the casing;

an opening positioned below the at least one aperture for receiving spent exothermic heat source material and casing material after the heat source has been applied against the casing; and a second interior space below the first interior space for accepting spent exothermic heat source material and melted casing material from the opening as the window is formed.

17. The method of claim 16, wherein the exothermic heat source material is thermite, and wherein the at least one aperture is fabricated from a ceramic material.

18. The method of claim 14, wherein the milling device defines a broach for mechanically cutting casing.

19. The method of claim 18, wherein the broach comprises:

a fluid source;

a fluid actuated motor;

a fluid source line for transporting fluid from the fluid source to the fluid actuated motor;

a compressor for placing the fluid source under pressure and for delivering fluid from the fluid source to the fluid actuated motor through the fluid source line;

a housing;

a piston residing within said housing, the piston having a back end and a front end;

a biasing member for biasing the piston to reside within the housing;

a fluid intake line for providing fluid from the motor to said the housing at the back end of the piston, the pressure from the fluid intake line being capable of overcoming the biasing member so as to extrude said piston from the housing;

a fluid outtake line for returning the fluid from said housing to the fluid source; and a series of teeth at the front end of the piston for milling the casing, thereby creating the window when the teeth reciprocate against the casing.

20. The method of claim 19, wherein the motor comprises:

a drive shaft which rotates when the fluid actuated motor is activated;

a cam having a wave form face, the cam being rotated by the drive shaft;

a vertical plunger having a top end and a bottom end, the bottom end being connected to the housing of the broach, and the top end being acted upon by the wave form face of the cam when the drive shaft is rotated so as to cause the plunger to reciprocate translationally, and thereby causing the broach to reciprocate axially.

21. The method of claim 20, wherein the cam is connected to the drive shaft, and the wave form on the face of said cam is generally sinusoidal.

22. The method of claim 19, wherein the step of activating the milling device defines activating the fluid actuated motor.

23. The method of claim 22, further comprising a regulator connecting the fluid outtake line to the fluid source for controlling pressure in the fluid intake line.

24. The method of claim 23, wherein the regulator is a sized orifice.

25. The method of claim 22, wherein the pressure needed to overcome the biasing member of the reciprocating broach is greater than the pressure needed to activate the fluid actuated motor, and wherein the pressure needed to activate the fluid actuated motor is at approximately critical flow of the fluid source line.

26. The method of claim 18, wherein the broach comprises:

a fluid source;

a fluid actuated motor a motor shaft suspended from the motor, the motor shaft having a top end connected to the motor, and a bottom end connected to a first gear set, the first gear set being rotated by the motor;

a fluid source line for transporting fluid from the fluid source to the fluid actuated motor;

a compressor for placing the fluid source under pressure and for delivering fluid from the fluid source to the fluid actuated motor through the fluid source line;

a broach shaft disposed perpendicular to the motor shaft, the broach shaft having a first end and a second end, the first end being connected to a second gear set which is in mechanical communication with the first gear set such that rotation of the first gear set by said motor turns the second gear set which, in turn, rotates the broach shaft;

a broach having a series of teeth for mechanically cutting the casing upon rotation of the broach shaft, thereby creating the window when the teeth rotate against the casing; and a fluid outtake line for returning the fluid from the motor to the fluid source.

27. The method of claim 26, wherein the step of activating the milling device defines activating the fluid actuated motor.

28. The method of claim 27, further comprising a regulator connecting the fluid outtake line to the fluid source for controlling pressure in the fluid intake line.

29. The method of claim 14, wherein the milling device defines an explosive charge for explosively creating the opening in the casing.

30. The method of claim 29, wherein the explosive charge is administered by a perforating gun, the perforating gun being positioned at varying depths within the casing such that a plurality of explosive charges administered at the varying depths creates the opening in the casing.

* * * * *